US011827470B2

(12) United States Patent
Osada et al.

(10) Patent No.: US 11,827,470 B2
(45) Date of Patent: Nov. 28, 2023

(54) PAPER SHEET PROCESSING DEVICE, STACKING TRAY, AND PAPER SHEET STACKING METHOD

(71) Applicant: JAPAN CASH MACHINE CO., LTD., Osaka (JP)

(72) Inventors: Yoshihito Osada, Osaka (JP); Kazuya Furumachi, Osaka (JP); Yousuke Miyashita, Osaka (JP); Makoto Iwasaki, Osaka (JP); Nobuhiro Ida, Osaka (JP); Hirotaka Yamazaki, Osaka (JP); Rei Yamamoto, Osaka (JP); Takeaki Tanaka, Osaka (JP)

(73) Assignee: JAPAN CASH MACHINE CO., LTD., Osaka (JP)

( * ) Notice: Subject to any disclaimer, the term of this patent is extended or adjusted under 35 U.S.C. 154(b) by 118 days.

(21) Appl. No.: 17/593,975

(22) PCT Filed: Mar. 3, 2020

(86) PCT No.: PCT/JP2020/008939
§ 371 (c)(1),
(2) Date: Sep. 29, 2021

(87) PCT Pub. No.: WO2020/213272
PCT Pub. Date: Oct. 22, 2020

(65) Prior Publication Data

US 2022/0177253 A1 Jun. 9, 2022

(30) Foreign Application Priority Data

Apr. 18, 2019 (JP) ..... 2019-079154

(51) Int. Cl.
*B65H 29/40* (2006.01)
*B65H 31/32* (2006.01)
(Continued)

(52) U.S. Cl.
CPC ..... *B65H 29/40* (2013.01); *B65H 31/02* (2013.01); *B65H 31/32* (2013.01);
(Continued)

(58) Field of Classification Search
CPC ..... B65H 29/38; B65H 29/40; B65H 31/02; B65H 31/04; B65H 31/06; B65H 31/24;
(Continued)

(56) References Cited

U.S. PATENT DOCUMENTS 1,985,547 A 12/1934 Quick et al.
4,593,896 A 6/1986 Nakamura
(Continued)

FOREIGN PATENT DOCUMENTS

CN 102275765 A 12/2011
CN 203921292 U 11/2014
(Continued)

OTHER PUBLICATIONS

WIPO, Japan International Search Authority, International Search Report (with translation) and Written Opinion dated May 19, 2020 in International Patent Application No. PCT/JP2020-008939, 11 pages.

(Continued)

*Primary Examiner* — Prasad V Gokhale
(74) *Attorney, Agent, or Firm* — MASUVALLEY & PARTNERS; Peter Martinez

(57) ABSTRACT

The paper sheet processing device includes a bladed wheel 10, a paper sheet supply/transport unit 30, 100, a stacking tray 50 that holds paper sheets emitted from the bladed wheel one by one in a stacked state, and an extraction area 80. The stacking tray includes a first stacking part 51 that stacks thereon paper sheets being emitted when at a paper sheet stacking position P1, and is rotationally moved to a non-stacking position P2 when a predetermined number of (Continued)

paper sheets are stacked thereon, and a second stacking part 61 that is moved to the paper sheet stacking position to stack paper sheets thereon when being rotated by a predetermined angle from the non-stacking position, and is rotationally moved to the non-stacking position when the predetermined number of paper sheets are stacked thereon.

7 Claims, 11 Drawing Sheets

(51) Int. Cl.
*B65H 31/02* (2006.01)
*B65H 31/30* (2006.01)

(52) U.S. Cl.
CPC ..... *B65H 31/3072* (2013.01); *B65H 2404/65* (2013.01); *B65H 2701/1912* (2013.01)

(58) Field of Classification Search
CPC ..... B65H 31/3054; B65H 31/3063; B65H 31/3072; B65H 31/32; B65H 2404/65; B65H 2404/652; B65H 2404/653; B65H 2404/654; B65H 2701/1912
See application file for complete search history.

(56) References Cited

U.S. PATENT DOCUMENTS

| | | | | |
|---|---|---|---|---|
| 2005/0253322 | A1 | 11/2005 | Leuthold | |
| 2014/0044515 | A1* | 2/2014 | Liu | B65H 31/3045 414/788.1 |
| 2014/0190132 | A1* | 7/2014 | De Matteis | B65H 31/3081 414/789.2 |

FOREIGN PATENT DOCUMENTS

| | | | |
|---|---|---|---|
| EP | 0537125 | A1 | 4/1993 |
| EP | 2623450 | A1 | 8/2013 |
| JP | S59-182156 | A | 10/1984 |
| JP | 2003-054820 | A | 2/2003 |
| JP | 4390145 | B2 | 10/2009 |
| JP | 2016-113232 | A | 6/2016 |

OTHER PUBLICATIONS

CNIPA, Chinese Office Action issued in 202080027578.X dated Jan. 4, 2023, with search report, total 10 pages.
Chinese National Intellectual Property Administration, Chinese Office Action issued in CN202080027578.X dated May 23, 2023, with search report, total 12 pages.
European Patent Office, European Search Report issued in EP20790732.0 dated May 26, 2023, 19 pages.

* cited by examiner

CS
100a
100A
B
B1
B2
B3
B4
BB1
S1E
S2E
S3E
S1R
S2R
S3R
SA
SU
P1
P2
50(UN2)
10(UN1)
11
15
17
26a
51
52
54a
54b
56
56a
57
57a
61
80
85

PAPER SHEET PROCESSING DEVICE, STACKING TRAY, AND PAPER SHEET STACKING METHOD

RELATED APPLICATIONS

This application is the U.S. National Phase of and claims priority to International Patent Application No. PCT/JP2020/008939, International Filing Date Mar. 3, 2020, entitled Paper Sheet Processing Device, Stacking Tray, And Paper Sheet Stacking Method; which claims benefit of Japanese Patent Application No. 2019-079154 filed Apr. 18, 2019; both of which are incorporated herein by reference in their entireties.

FIELD

The present invention relates to improvement of a paper sheet processing device such as a banknote counting device, a stacking tray, and a paper sheet stacking method.

BACKGROUND

A banknote counting device as a kind of a banknote processing device has a configuration in which banknotes are transported to a recognition unit by feeding the banknotes, while separating the banknotes one by one from a banknote batch stacked in a hopper unit, and banknotes for which recognition of the denomination, the authenticity, and the like has been made are transported into a stacker (a storage) by a bladed wheel, while counting the banknotes, thereby restacking a predetermined number of banknotes in an aligned state. The banknote batch restacked in the stacker until reaching a predetermined number of banknotes (a specified number of banknotes) are manually extracted and subjected to processing such as bundling.

However, according to a conventional banknote counting device, counting processing is temporarily stopped at a time when a predetermined number of banknotes are stacked in the stacker, and the counting processing is interrupted to be in a standby state until the stacked banknote batch is removed from the stacker. In order to resume the counting processing, the stacked banknote batch needs to be removed.

Meanwhile, a worker needs not only to extract the banknote batch from the stacker but also to perform various cumbersome operations requiring time such as bundling the extracted banknote batch with a strap or a rubber band, and preparing a banknote batch to be counted next. Since extraction of the banknote batch is performed during such operations, the banknote batch cannot always be extracted from the stacker immediately after counting and stacking of the predetermined number of banknotes are complete, and the extraction timing of the banknote batch is delayed. Therefore, the standby state of the counting device occurs frequently, or the waiting time becomes long, thereby considerably decreasing the efficiency of operations such as banknote counting and bundling. Particularly, when a large number of banknotes are to be counted, there is a strong demand to perform the counting processing continuously without stopping the counting operation as much as possible, or in a minimum necessary downtime. However, this demand has not been met yet.

To resolve such a standby state and reduce the waiting time, a device in which a plurality of stackers are provided and when the number of stacked banknotes in one stacker has reached a predetermined number, subsequent banknotes are stacked in another stacker by a switching unit has been proposed. However, the device becomes large and expensive.

Patent Literature 1 discloses a stacking method and a stacking device of sheet materials including a stacking mechanism that separates and stacks banknotes continuously supplied from a hopper in a predetermined number of banknotes, for example, in a unit of 100 banknotes. The device pulls the banknotes rotationally moved in a state being inserted between blades of a bladed wheel out of the bladed wheel by a stripper to drop the banknotes onto a stacking shelf and stack the banknotes thereon, and when the number of stacked banknotes has reached a predetermined number, the stripper is evacuated to a position at which the stripper does not interfere with the banknotes on the bladed wheel. After the predetermined number of banknotes are stacked on the stacking shelf, before the stacked banknote batch is removed from the stacking shelf, an auxiliary stacking shelf is introduced between the bladed wheel and the stacked banknotes, thereby continuously stacking the subsequent banknotes on the auxiliary stacking shelf. With this configuration, the downtime can be reduced by separating the banknote batch stacked in the predetermined number and the subsequent banknote batch.

However, Patent Literature 1 has the following problems.

First, speeding up of processing of banknotes, for example, high-speed processing of about 15 sheets per second is required for banknote counting devices in recent years. However, in the device of Patent Literature 1, the stripper needs to be evacuated within a quite short time after a predetermined number of banknotes, for example, 100 banknotes have been stacked on the stacking shelf until the subsequent 101st banknote continuously supplied thereto reaches the stacking shelf, and thus there is a problem in the responsiveness of the stripper. It is doubtful that a mechanism for causing the stripper to perform such a high speed operation can be realized. That is, the configuration disclosed in Patent Literature 1 is not suitable for performing high-speed processing such as 15 sheets per second.

Further, while the stripper is evacuated, banknotes are sequentially set into an individual banknote storing space between the adjacent blades and stored in a state in which a plural number of banknotes are stacked. Therefore, there is a high possibility that collision between (jam of) banknotes may occur in the individual banknote accommodating space. That is, it is not possible to realize high speed processing of banknotes while preventing jam by storing only one banknote in the banknote accommodating space.

Further, in banknote counting devices in recent years, such a mechanism is desired in which a serial number of a banknote transported from the hopper is sequentially read one by one and recorded and used in the order of transport. However, if a plurality of banknotes are held in a state overlapped on each other in the banknote accommodating space between the blades, when the banknotes are pulled out from between the blades and stacked, the banknotes cannot be stacked in the order of transport. That is, in Patent Literature 1, after all the 100 banknotes, which is in a unit of sheets to be stacked, are held in each banknote accommodating space of the bladed wheel, the stripper is operated to pull the banknotes out of each banknote accommodating space onto the stacking shelf. However, since the number of banknote accommodating spaces formed between the blades of the bladed wheel is less than 100, which is the unit of sheets to be stacked, the banknotes need to be stacked in a state overlapped on each other in one banknote accommodating space. In a case where the number of banknote accommodating spaces is 20, if the first banknote is accommodated in the first banknote accommodating space, which has moved to a banknote supply position on an outer periphery of the bladed wheel, and the second banknote is accommodated in the next banknote accommodating space sequentially, the 21st banknote is to be accommodated overlapped on the first banknote in the first accommodating space. When accommodation of the 100th banknote is complete, five banknotes are eventually accommodated in all the banknote accommodating spaces. At this stage, if the stripper is operated to pull the banknote batch out of each banknote accommodating space and sequentially stack the banknote batch on the stacking shelves, the order of banknotes becomes different from the order of banknotes fed from the hopper. That is, regarding the first banknote accommodating space, the 21st banknote is stacked on the first banknote, the 41st banknote is stacked thereon, the 61st banknote is stacked thereon, and then the 81st banknote is stacked thereon sequentially. Therefore, the order of stacked banknotes on the stacking shelf is in this order.

In this manner, according to the device configuration of Patent Literature 1, the serial number of banknotes transported from the hopper cannot be read one by one sequentially and recorded and used in the order of transport.

CITATION LIST

Patent Literature

Patent Literature 1: Japanese Patent No. 4390145

SUMMARY

Technical Problem

The present invention has been achieved in view of the situation described above, and an object of the present invention is to provide a paper sheet processing device, a stacking tray, and a paper sheet stacking method that can resume stacking processing via a quite short downtime, without increasing the size and the cost of the device due to addition of a stacker when a large number of paper sheets are continuously counted and stacked, causing occurrence of jam of paper sheets in a paper sheet storing space of a bladed wheel, and removing a batch of paper sheets stacked in advance from the stacker.

Further, it is another object of the present invention to set the stacking order of paper sheets to be emitted from the bladed wheel and stacked to be the same order as that at the time of feeding the paper sheets from a hopper.

Solution to Problem

In order to achieve the above object, a paper sheet processing device according to the present invention comprises: a bladed wheel configured to include a plurality of blades projecting radially around a rotary shaft, and a paper sheet holding space formed between the blades adjacent to each other in a circumferential direction to hold one received paper sheet so as to take in and out the paper sheet freely, and sequentially emit one paper sheet each held in the paper sheet holding space to a predetermined stacking area at a time of rotation in one direction; a paper sheet supply/transport unit configured to supply paper sheets one by one to each of the paper sheet holding spaces of the rotating bladed wheel; a stacking tray arranged in the stacking area to hold paper sheets emitted from each of the paper sheet holding spaces one by one in a stacked state and rotates around a rotary shaft; a stacked paper sheet-batch extraction area, which is a transfer destination of a batch of paper sheets stacked on the stacking tray and stores therein the batch of paper sheets in a state capable of taking out the batch of paper sheets to outside; a drive mechanism; and a control unit configured to control the drive mechanism, wherein the stacking tray includes at least a first stacking part that stacks emitted paper sheets when at a paper sheet stacking position (paper sheet receiving posture) facing the bladed wheel and is rotationally moved to a non-stacking position not facing the bladed wheel when a predetermined number of paper sheets are stacked thereon, and a second stacking part that is moved to the paper sheet stacking position to stack thereon emitted paper sheets when being rotated by a predetermined angle from the non-stacking position not facing the bladed wheel, and is rotationally moved to the non-stacking position when a predetermined number of paper sheets are stacked thereon, and the first stacking part and the second stacking part are located in the stacked paper sheet-batch extraction area when each part is at the non-stacking position.

Advantageous Effects of Invention

According to the present invention, in a case of performing continuous counting processing of a large number of paper sheets and then performing stacking processing, it is possible to resume stacking processing via a quite short downtime without removing a batch of paper sheets stacked in advance from a stacker.

DESCRIPTION OF EMBODIMENTS

Figure 1:
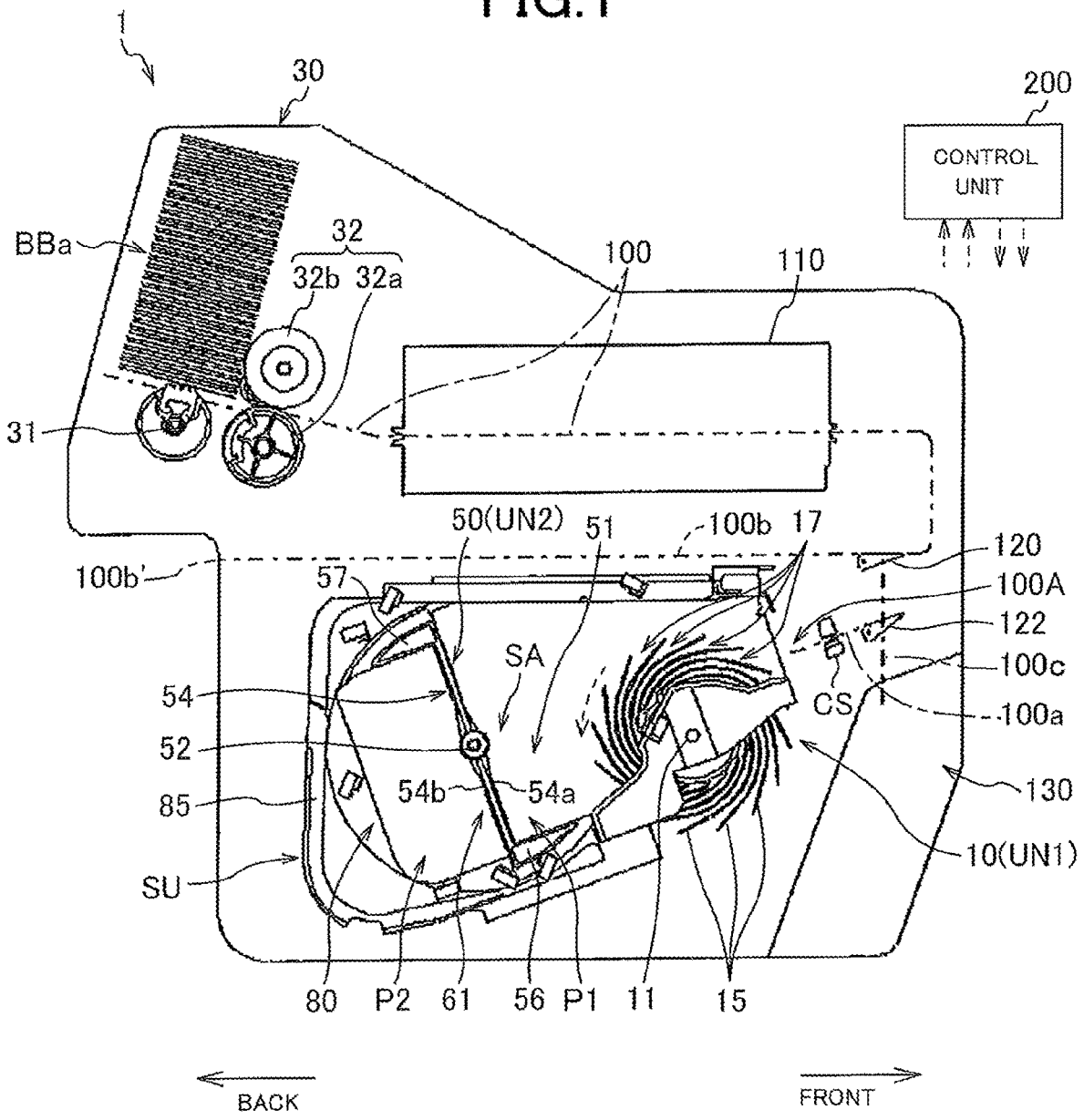
FIG. 1 is an explanatory diagram of an internal configuration illustrating a schematic configuration of an embodiment of a banknote counting device as an example of a paper sheet processing device of the present invention.

The present invention will be described below in detail with embodiments illustrated in the drawings.

First Embodiment

[1-1: Basic Configuration]

Figure 2A:
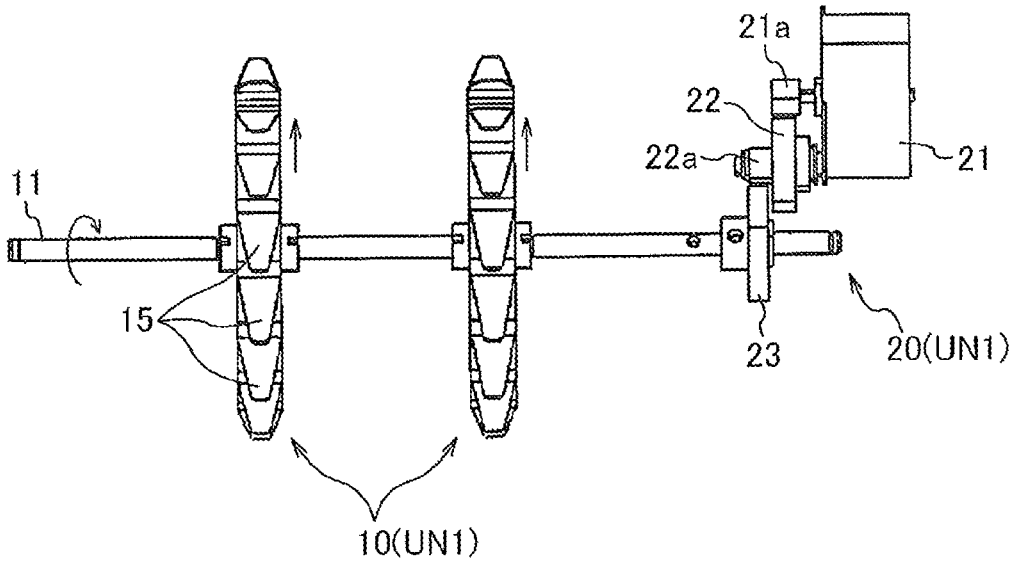
FIGS. 2(*a*) and (*b*) are a side view and a perspective view of a bladed wheel and a drive mechanism thereof (a bladed wheel drive unit UN1).
Figure 2B:
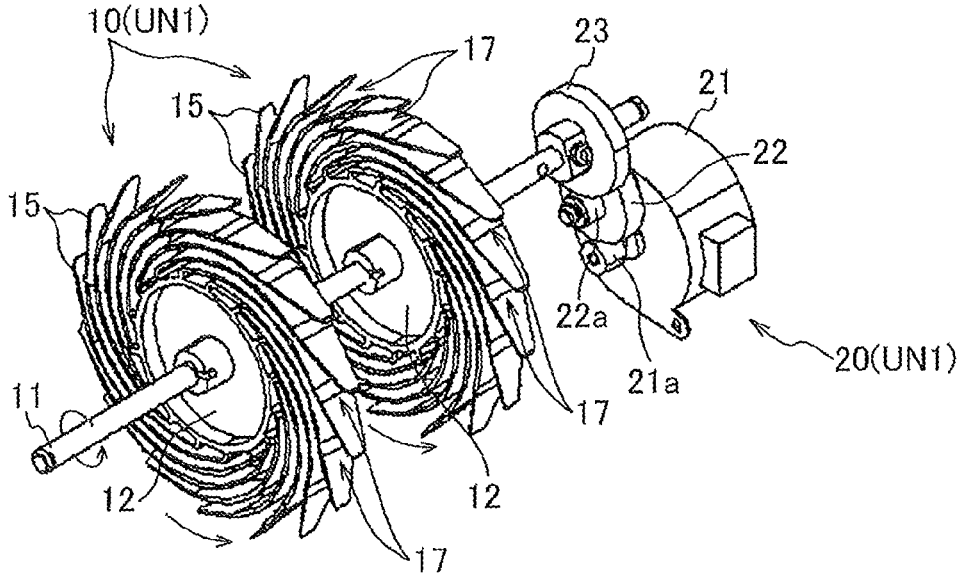
Figure 3A:
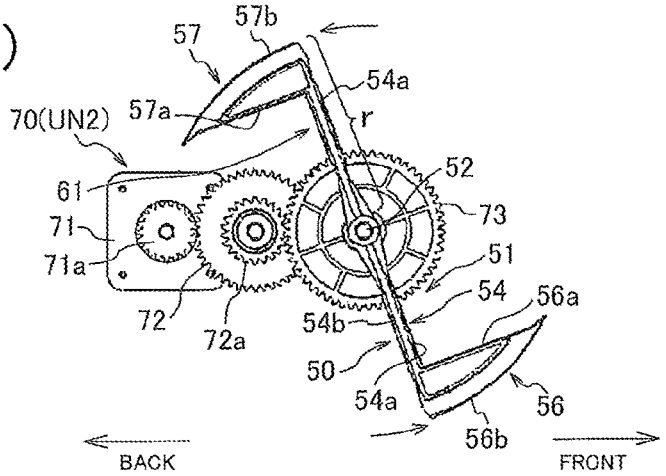
FIGS. 3(*a*), (*b*), and (*c*) are a front view, a perspective view from one side, and a perspective view from the other side of a stacking tray and a drive mechanism thereof (a stacking tray drive unit UN2).
Figure 3B:
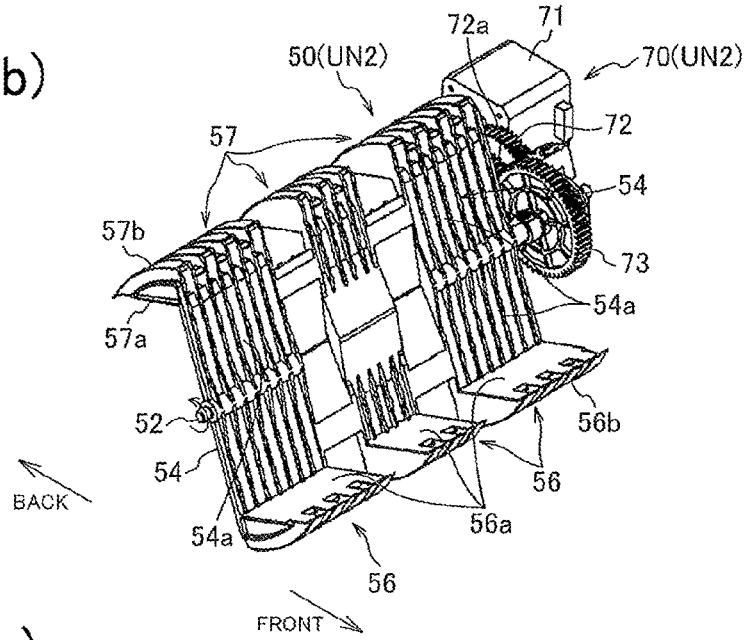
Figure 3C:
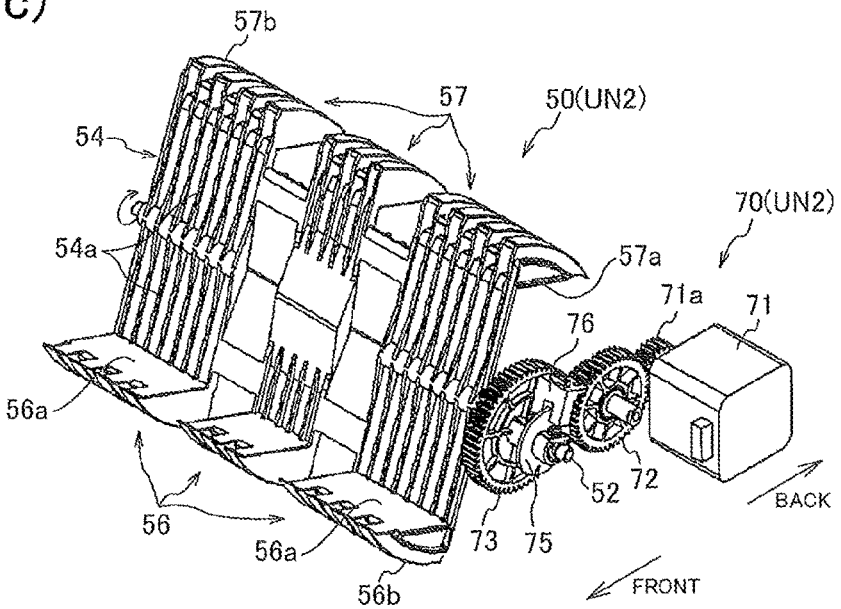
Figure 4A:
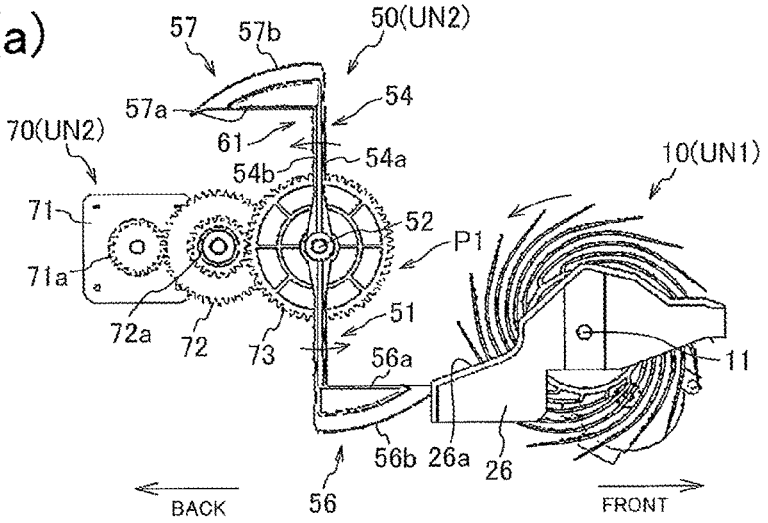
FIGS. 4(*a*), (*b*), and (*c*) are a front view, a perspective view from one side, and a perspective view from the other side illustrating a combined state of the bladed wheel drive unit in FIG. 2 and the stacking tray drive unit in FIG. 3.
Figure 4B:
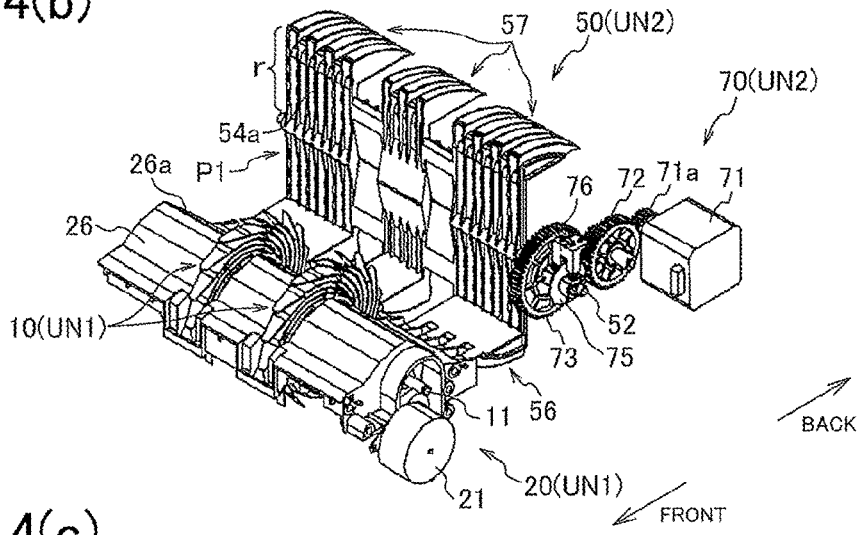
Figure 4C:
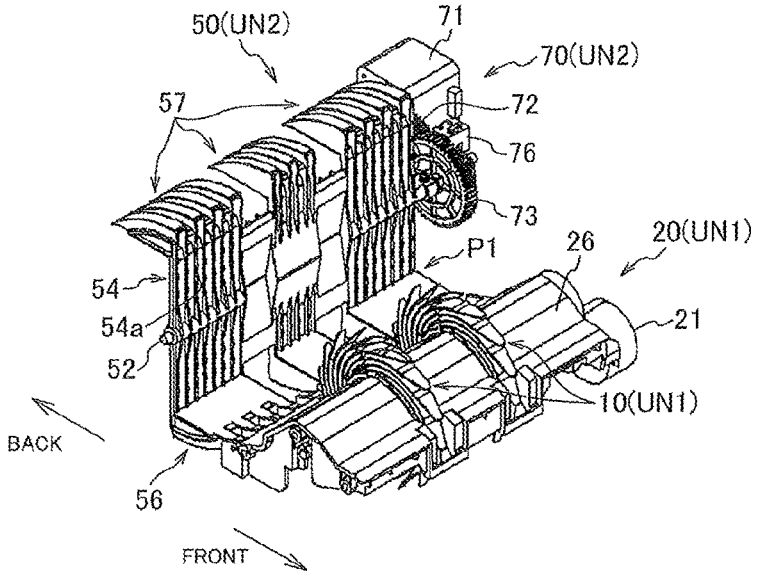
Figure 5:
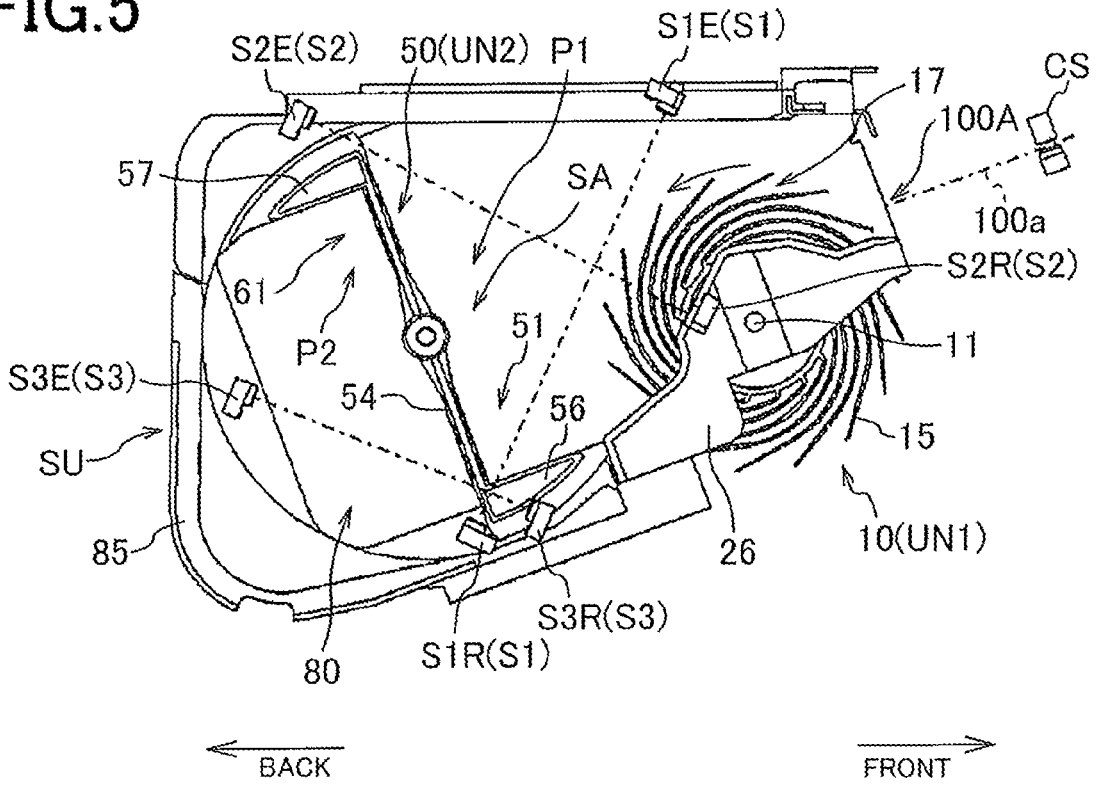
FIG. 5 is an explanatory diagram illustrating an arrangement example of various sensors arranged in a stacker unit (the bladed wheel and the stacking tray).

FIG. 1 is an explanatory diagram of an internal configuration illustrating a schematic configuration of an embodiment of a banknote counting device as an example of a paper sheet processing device of the present invention. FIGS. 2(*a*) and (*b*) are a side view and a perspective view of a bladed wheel and a drive mechanism thereof (a bladed wheel drive unit UN1). FIGS. 3(*a*), (*b*), and (*c*) are a front view, a perspective view from one side, and a perspective view from the other side of a stacking tray and a drive mechanism thereof (a stacking tray drive unit UN2). FIGS. 4(*a*), (*b*), and (*c*) are a front view, a perspective view from one side, and a perspective view from the other side illustrating a combined state of the bladed wheel drive unit in FIG. 2 and the stacking tray drive unit in FIG. 3. FIG. 5 is an explanatory diagram illustrating an arrangement example of various sensors arranged in a stacker unit (the bladed wheel and the stacking tray).

In the present embodiment and all the embodiments described below, a banknote is explained as an example of a paper sheet. However, the paper sheet includes not only a banknote but also a sheet-like item regardless of the material, such as marketable securities, cash vouchers, and tickets.

A banknote counting device 1 includes a bladed wheel 10 that includes a rotary shaft 11, a plurality of blades 15 projecting radially and spirally (in a curved state) around the rotary shaft, and a banknote holding space 17 formed between blades adjacent to each other in a circumferential direction to hold one received banknote so as to take in and out the banknote freely, and sequentially emits one banknote each held in each banknote holding space to a predetermined banknote stacking area at the time of rotation in a banknote storing direction indicated by an arrow. Further, the banknote counting device 1 includes a banknote supply unit (a hopper, a banknote supply/transport unit) 30 that supplies banknotes one by one to a banknote transport path (the banknote supply/transport unit) 100 for supplying banknotes one by one to each banknote holding space 17 of the rotating bladed wheel from an outer diameter direction. The banknote counting device 1 also includes a stacking tray (a rotary stacker) 50 arranged in a banknote stacking area SA to stack and hold banknotes B emitted from each banknote holding space 17 one by one in a stacked state and rotates around a rotary shaft 52, a stacked banknote-batch extraction area (an extraction area, a stacker) 80, which is a transfer destination of a banknote batch BB stacked on the stacking tray 50 and stores therein the banknote batch in a state capable of extracting the banknote batch to outside, and a control unit 200 that controls various types of control targets such as a drive mechanism.

The stacking tray 50 includes at least a first stacking part 51 that stacks thereon banknotes sequentially emitted from each banknote holding space 17 when being at a banknote stacking position (banknote receiving posture) P1 facing the bladed wheel 10 and is rotationally moved to a non-stacking position P2 not facing the bladed wheel when a predetermined number of banknotes are stacked thereon, and a second stacking part 61 that is transferred to the banknote stacking position P1 to stack thereon emitted banknotes when being rotated by a predetermined angle from the non-stacking position (non-stacking posture) P2 not facing the bladed wheel and rotationally moved to the non-stacking position when a predetermined number of banknotes are stacked thereon. The first stacking part and the second stacking part are located in the stacked banknote-batch extraction area 80 when each part is at the non-stacking position P2 (are continuous to the stacked banknote-batch extraction area 80).

In this example, the stacking tray 50 includes two stacking parts. However, this is only an example, and only one stacking part may be provided, or more than three stacking parts may be provided as described below.

The stacked banknote-batch extraction area (the extraction area, the stacker) 80 is a space for storing each stacking part and the banknote batch in each stacking part when the first stacking part 51 and the second stacking part 61 are at the non-stacking position P2 not facing the bladed wheel 10, and is configured such that the banknote batch in the extraction area can be extracted to outside of the device by a worker.

A specific configuration of the banknote counting device 1 is described below in more detail.

The banknote supply unit 30 includes a feed roller 31 that feeds a banknote on the lowermost surface by coming into contact with a bottom surface of a batch BBa of a large number of banknotes before being counted, which are stacked on a stacking plate (not illustrated), and rotating, and a separation roller pair 32 for preventing double feed that delivers the fed banknotes to the banknote transport path (the banknote supply/transport unit) 100 while separating the banknotes. The separation roller pair 32 is configured by a lower feed roller 32*a* rotationally driven in a paper feed direction and a brake roller 32*b* made of a high friction material and arranged above the feed roller to nip the banknote between the feed roller and the brake roller.

The banknote transport path (the banknote supply/transport unit) 100 configured by transport means such as a belt or a roller (not illustrated) and a motor is provided between the banknote supply unit 30 and the bladed wheel 10, and a recognition unit 110 that judges the authenticity and the denomination of banknotes is provided on the banknote transport path 100. A first gate 120 and a second gate 122 are sequentially arranged at positions before the bladed wheel 10 on the banknote transport path. Each gate is configured to freely turn around a turnable shaft and be turned by a solenoid (a drive mechanism) (not illustrated), and controlled by the control unit 200 to operate, thereby selectively switching a transport destination of banknotes to a normal transport path 100*a*, a diverted transport path 100*b*, or a reject transport path 100*c*.

The first gate 120 is switching means, when another stacker unit SU is connected as described below, for switching the transport destination to the diverted transport path 100*b* for transporting the banknote to the other stacker unit (to be described with reference to FIG. 9). The second gate 122 is switching means for switching the transport destination of the banknote to either the normal transport path 100*a* toward the bladed wheel 10 or the reject transport path 100*c* for transporting the banknote to a reject unit 130 provided down below.

The control unit (a CPU, a ROM, and a RAM) 200 controls each control target based on an operation signal from an operation switch, detection signals from various sensors, and the like.

The bladed wheel 10 configures the bladed wheel drive unit UN1 together with a drive mechanism 20 thereof.

The stacking tray 50 configures the stacking tray drive unit UN2 together with a drive mechanism 70 thereof.

Next, the bladed wheel drive unit UN1 is described with reference to FIG. 2 and FIG. 4.

In this example, each shaft core of two bladed wheels 10 having the same shape is fixed to the rotary shaft 11 with a predetermined axial interval therebetween, and the bladed wheels 10 are rotated while holding two positions in a long side of a banknote transported in a posture with a short side being parallel to a transport direction in the banknote holding space 17 formed between the blades 15 of the two bladed wheels. Each bladed wheel 10 includes a disk-shaped base 12 integrated with the rotary shaft 11, a plurality of blades 15 made of an elastic material and projecting radially and spirally (in a curved state) from an outer periphery of the base, and the banknote holding space 17 formed between blades adjacent to each other in the circumferential direction to hold one received banknote so as to take in and out the banknote freely.

The bladed wheel drive mechanism 20 schematically includes a bladed wheel motor 21, a middle gear 22 meshed with an output gear 21*a* of the bladed wheel motor, and a driven gear 23 meshed with a small gear 22*a* integrated with the middle gear 22 in a state where a shaft core is fixed to the rotary shaft 11. By driving the bladed wheel motor 21, the bladed wheel 10 is rotated in the banknote storing direction indicated by an arrow.

As illustrated in FIG. 4, at the time of assembling the bladed wheel drive unit UN1 with the stacking tray drive unit UN2, a space between the bladed wheels and an outside space of each bladed wheel are covered with a bladed wheel guide 26 so as to cover the rotary shaft 11. An upper surface of the bladed wheel guide (a stopper for pulling out banknotes) 26*a* has a positional relation with a banknote B to interfere with the long side on an inner diameter side of the banknote B held by the two bladed wheels while being rotationally moved. Therefore, the banknote B is pushed up by the upper surface 26*a* at a point in time when the banknote B comes into contact with the upper surface 26*a* and thereafter. A pushing force thereof works in a direction of pulling the banknote out of the banknote holding space 17, and the banknote pulled out of each banknote holding space is sequentially emitted to the stacking area SA located in the outer diameter direction of the bladed wheel. Therefore, the subsequent banknote is not held overlapped on a previous banknote in one banknote holding space. Further, since the banknote in the banknote holding space is reliably pulled out therefrom by the upper surface 26*a*, the banknote is not held when the bladed wheel rotates thereafter and the banknote holding space reaches a banknote supply position 100A.

Next, the stacking tray drive unit UN2 is described with reference to FIG. 3 and FIG. 4.

The stacking tray 50 as a rotary stacker is arranged in the stacking area SA to which a banknote pulled out of each banknote holding space 17 of the bladed wheel is emitted, and the stacked banknote-batch extraction area (the extraction area) 80 as a transfer destination of the banknote batch (batch of paper sheets) BB stacked on the stacking tray is arranged behind the stacking area SA.

The stacking tray 50 has a rotationally symmetric shape having a base plate 54 integrated with the rotary shaft 52 at an intermediate part thereof to support a back surface of a banknote batch, and a first bottom plate 56 and a second bottom plate 57 each projecting in an opposite direction from opposite edges on an outer diameter side of the base plate with an angle of about 90 degrees.

The base plate 54 forms the first stacking part 51 between a first surface 54*a* and the first bottom plate 56. When the first bottom plate 56 is at the banknote stacking position (banknote receiving posture) P1 located on a lower side illustrated in the drawing, a lower end surface of the banknote batch BB with one surface coming into contact with the first surface 54*a* can be supported by a banknote support surface 56*a* (see FIG. 6(*d*)).

The base plate 54 forms the second stacking part 61 between a second surface 54*b* and the second bottom plate 57. When the second bottom plate 57 is at the banknote stacking position (banknote receiving posture) P1 located on a lower side as illustrated in FIG. 7(*f*), the lower end surface of the banknote batch BB with one surface coming into contact with the second surface 54*b* is supported by a banknote support surface 57*a*.

The banknote support surfaces 56*a* and 57*a* being inner diameter side surfaces of the respective bottom plates 56 and 57 have a flat surface having an area suitable for supporting an end surface of the banknote batch, whereas outer diameter side surfaces 56*b* and 57*b* have a curved surface or an arc-shaped surface along a circumference formed by a radius r around a rotary shaft, in order to reduce the radius of movement at the time of rotation as much as possible.

Figures 6A, 6B, 6C, 6D, 6E:
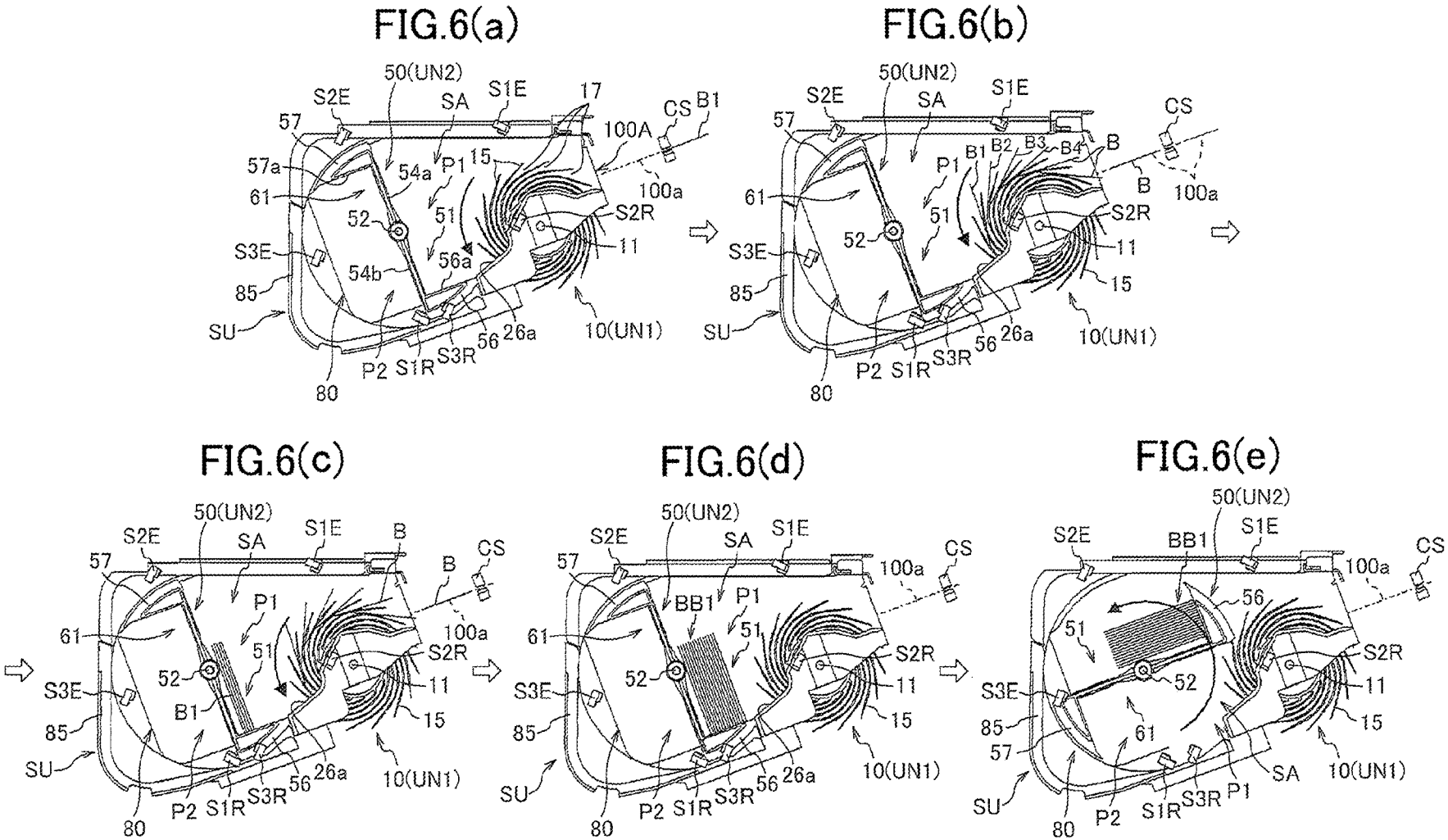
FIGS. 6(*a*) to (*e*) are explanatory diagrams of counting of banknotes and a stacking operation by a banknote processing device.
Figure 7F:
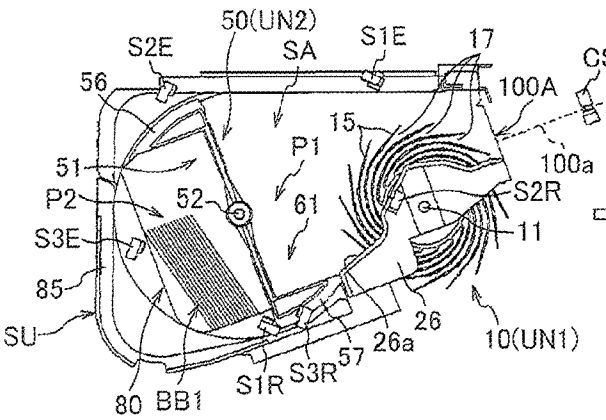
FIGS. 7(*f*) to (*j*) are explanatory diagrams of counting of banknotes and a stacking operation by the banknote processing device continuing from FIG. 6(*e*).
Figure 7G:
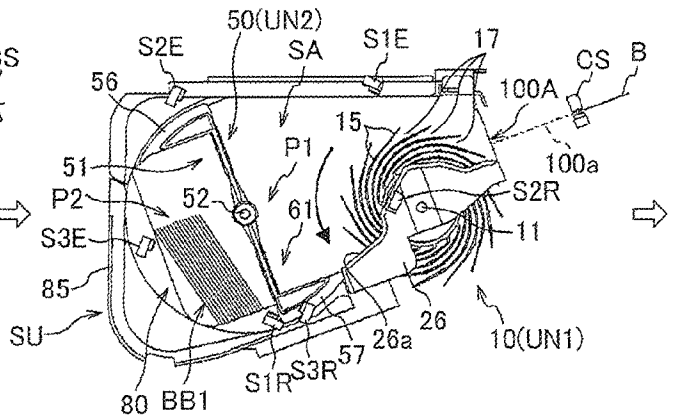
Figure 7H:
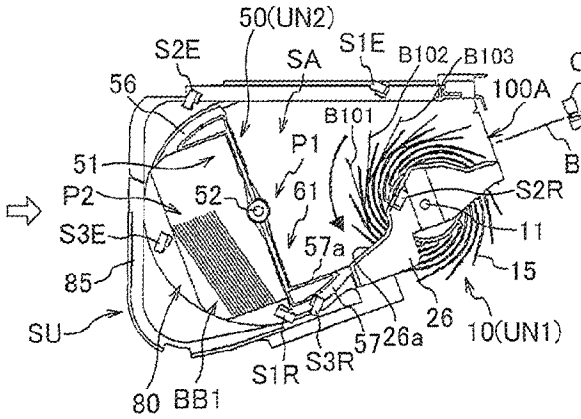
Figure 7I:
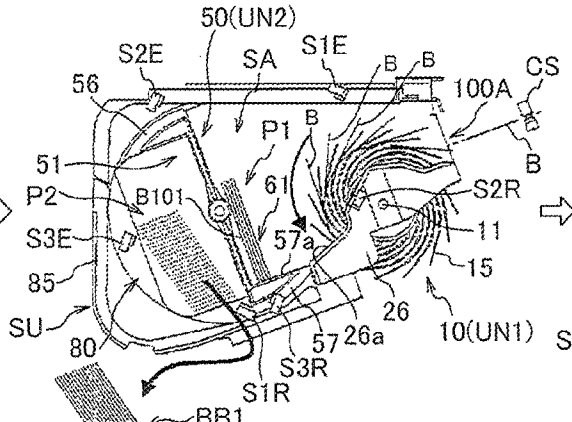
Figure 7J:
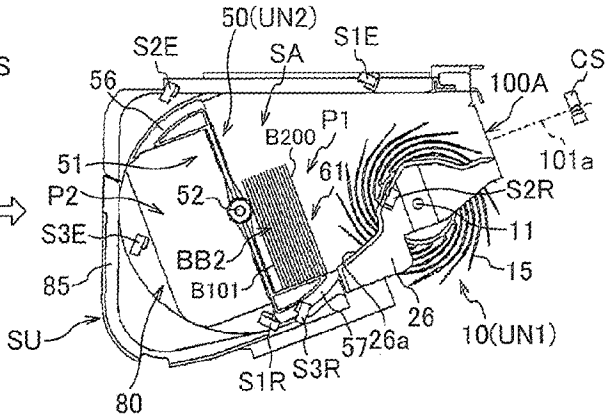

When the stacking tray 50 is at the banknote stacking position P1 illustrated in FIG. 6(*a*), the first stacking part 51 faces the bladed wheel to receive banknotes emitted one by one from the bladed wheel sequentially and hold the banknote in a standing state. Further, when the stacking tray 50 is at the banknote stacking position P1 illustrated in FIG. 7(*f*), the second stacking part 61 faces the bladed wheel to receive banknotes emitted one by one from the bladed wheel sequentially and hold the banknote in a state standing on the second bottom plate 57.

When the first stacking part 51 of the stacking tray is at the banknote stacking position P1 facing the bladed wheel 10, the second stacking part 61 is at the non-stacking position P2 not facing the bladed wheel 10, and when the second stacking part 61 is at the banknote stacking position facing the bladed wheel, the first stacking part 51 is at the non-stacking position P2 not facing the bladed wheel.

The drive mechanism 70 of the stacking tray schematically includes a stacking tray motor 71, a middle gear 72 meshed with an output gear 71*a* of the stacking tray motor, and a driven gear 73 meshed with a small gear 72*a* integrated with the middle gear 72 in a state where a shaft core is fixed to the rotary shaft 52. By driving the stacking tray motor 71, the stacking tray 50 is rotated in a switching direction indicated by an arrow. In this example, the stacking tray 50 stops rotation to stack banknotes when the first stacking part 51 is at the banknote stacking position P1, and after stacking completion of a predetermined number of banknotes, the stacking tray 50 is rotated by 180 degrees to rotationally move the second stacking part 61 to the banknote stacking position and stops to repeat the receiving operation of the subsequent banknote. Further, a home-position detection plate 75 is fixed to the rotary shaft 52, and is configured such that a photo interrupter 76 fixed to a device body side detects a slit (a hole) formed along the rim of the home-position detection plate 75, thereby to detect a home position of the stacking tray. The stacking tray is at a first home position when the first stacking part 51 is at the stacking position, and is at a second home position when the second stacking part 61 is at the stacking position.

The bladed wheel drive unit UN1, the stacking tray drive unit UN2, the extraction area 80, and a casing 85 for supporting these units constitute a stacker unit SU.

FIG. 5 illustrates various sensors for banknote detection installed in the stacker unit SU. A banknote counting sensor CS is a photo interrupter that counts banknotes passing through the normal transport path 100*a*, and is means for counting the number of banknotes emitted to the first stacking part 51 and the second stacking part 61 and stacked thereon by counting the number of banknotes supplied from the banknote supply position 100A to the bladed wheel.

A first banknote-presence detection sensor S2 (a light emitting element S1E and a light receiving element S1R) is a photo interrupter that detects the presence of banknotes in the first stacking part 51 and the second stacking part 61 when located in the banknote stacking area SA. A second banknote-presence detection sensor S2 (a light emitting element S2E and a light receiving element S2R) is a photo interrupter that detects the presence of banknotes held by the bladed wheel and the presence of banknotes in a space between the bladed wheel and the banknote stacking area SA. A third banknote-presence detection sensor S3 (a light emitting element S3E and a light receiving element S3R) is a photo interrupter that detects the presence of banknotes in the extraction area 80.

Next, banknote counting and stacking operations (a stacking operation and a stacking method) by the present banknote processing device are described with reference to FIG. 6 and FIG. 7. In FIG. 6 and FIG. 7, only a stacker unit SU in which illustrations of the banknote supply unit 30, the banknote transport path 100, the recognition unit 110, and the like are omitted is illustrated.

FIG. 6(*a*) illustrates a state of a first banknote B1 fed from the banknote supply unit 30 to the banknote transport path 100 (both not illustrated) and fed to the normal transport path 100*a* through the first gate 120 and the second gate 122 immediately before reaching the banknote counting sensor CS. At this time, the control unit 200 starts to drive the bladed wheel motor 21 to rotate the bladed wheel 10 in the banknote storing direction indicated by an arrow, thereby inserting banknotes B1, B2, B3, . . . fed from the banknote supply position 100A on the right to an outer periphery of the bladed wheel sequentially into each banknote holding space 17, as illustrated in FIG. 6(*b*). At this time, the banknote counting sensor CS counts the number of banknotes passing therethrough.

When a long side on the inner diameter side (a long side on a forefront side in an insertion direction) of the first banknote B1 inserted into one banknote holding space 17 and held therein comes into contact with the upper surface (the stopper) 26*a* of the bladed wheel guide 26 with the rotation of the bladed wheel, the banknote B1 cannot follow the rotation of the bladed wheel anymore, and moves toward the stacking area SA, while being pulled out of the banknote holding space 17. At this point in time, since the first stacking part 51 is stopped in the banknote stacking area SA, the emitted banknote B1 is held in a state coming into contact with the first surface 54*a* of the base plate 54 and the banknote support surface 56*a* of the first bottom plate 56 constituting the first stacking part. The subsequent banknotes B2, B3, . . . are sequentially stacked on the front surface of the banknote B1 in the same manner (FIG. 6(*c*)).

FIG. 6(*d*) illustrates a time point when 100 banknotes BB1 have been stacked on the first stacking part 51 in this example. At this point in time, after the last 100th banknote has passed the banknote counting sensor CS and is stacked on the first stacking part 51 through the banknote holding space 17 of the bladed wheel, the bladed wheel 10 stops to stop banknote supply by the banknote supply unit 30 and transport via the banknote transport path 100. At this point in time, the subsequent 101st banknote may come to a position just before the banknote supply position 100A and stop, or the subsequent 102nd banknote and thereafter already fed by the banknote supply unit 30 may stop in the banknote transport path 100.

As in this example, when there is only one stacker unit SU, since banknotes cannot be transported to other stacker units, transport of all the banknotes in the single stacker unit SU stops. However, when a plurality of stacker units are connected as described below, since the 101st banknote and thereafter can be stacked continuously in other stacker units, not all the banknote transport paths need to be stopped.

Next, FIG. 6(*e*) illustrates a process to rotate the stacking tray 50 by 180 degrees by driving the stacking tray drive mechanism 70. After judging that a banknote batch BB1 of 100 sheets has been stacked on the first stacking part 51 by a count signal from the banknote counting sensor CS, and confirming that there is no other banknote in the stacked banknote-batch extraction area 80 by the third banknote-presence detection sensor S3, the control unit 200 rotates the stacking tray by 180 degrees.

FIG. 7(*f*) illustrates a state after the stacking tray 50 has been rotated by 180 degrees from the banknote stacking position P1 illustrated in FIG. 6(*d*), and in this state, the second stacking part 61 (the bottom plate 57) has been moved to the banknote stacking position. Since the first stacking part 51 moves to the non-stacking position P2 on the side of the extraction area 80 simultaneously therewith, the banknote batch BB1 held in the first stacking part moves to the extraction area 80 to become a state capable of being pulled out.

In FIG. 7(*g*), after the first and second banknote-presence detection sensors S1 and S2 confirm that there is no banknote in the stacking area SA, feed by the banknote supply unit 30 and banknote transport by the banknote transport path 100 are resumed, and the banknote counting sensor CS resumes rotation of the bladed wheel after detection of entrance of a banknote.

In this manner, the control unit 200 stops the paper sheet supply/transport operation by the paper sheet supply/transport units 30 and 100 and the paper sheet emitting operation by the bladed wheel, when a predetermined number of paper sheets have been stacked on the first stacking part 51 at the paper sheet stacking position, and resumes the paper sheet supply/transport operation and the paper sheet emitting operation when the stacking tray is rotated by a predetermined angle and the second stacking part 61 is transferred to the paper sheet stacking position.

That is, in the present configuration example, feed and transport by the banknote supply unit 30 are not continued when stacking of 100 banknotes on the first stacking part 51 is complete, and feed and transport of following banknotes are not resumed until the stacking tray 50 is rotated by 180 degrees after stacking completion and the banknote batch in the first stacking part 51 is moved toward the extraction area 80. However, since the downtime is within one second, even if high-speed counting processing of about 15 sheets per second is required, the entire processing speed is not delayed considerably.

In FIG. 7(*g*), when the first or second banknote-presence detection sensor S1 or S2 detects that there is a remaining banknote in the stacking area SA, it is determined that an error has occurred.

FIG. 7(*h*) illustrates a state in which take-in of the banknote by the bladed wheel is resumed, and banknotes B101, B102, B103, . . . are each held one by one sequentially in each banknote holding space 17.

In FIG. 7(*i*), the 101st banknote B101 and subsequent banknotes B102, B103, . . . held in the banknote holding space 17 come into contact with the upper surface (the stopper) 26*a* of the bladed wheel guide 26 with the rotation of the bladed wheel, and accordingly, each banknote moves toward the stacking area SA by being pulled out of the banknote holding space and is sequentially stacked on the second stacking part 61, in the same manner as illustrated in FIG. 6(*c*).

After the banknote batch BB1 stacked on the first stacking part 51 has moved to the extraction area 80, that is, after the stage illustrated in FIG. 7(*f*), the banknote batch BB1 can be pulled out anytime.

In FIG. 7(*j*), after the 200th banknote B200 has passed the banknote counting sensor CS and been stacked on the second stacking part 61, the bladed wheel stops. A reference sign BB2 represents a banknote batch of 100 sheets from the 101st banknote B101 to the 200th banknote B200.

This state is the same as the state illustrated in FIG. 6(*d*), and by repeating the states in FIG. 6(*e*) and FIGS. 7(*f*) to (*j*), continuous processing can be performed. That is, transport by the banknote supply unit 30 and the banknote transport path 100 is interrupted at a point in time when it is judged that the 200th banknote has been stacked on the second stacking part 61, and the stacking tray 50 is rotated by 180 degrees subject to no presence of a banknote batch in the extraction area 80. Accordingly, feed and transport by the banknote supply unit 30 and the banknote transport path 100 are resumed at a timing when the first stacking part 51 is returned to the stacking area SA, thereby enabling to start stacking of the 201st banknote and thereafter.

Next, details of a banknote counting procedure (a banknote stacking method) by the banknote processing device according to the present invention are described with reference to a flowchart in FIG. 8.

In order to start the counting processing, at step S1, banknotes are taken out one by one from the lowermost banknote in a banknote batch BBa before being counted and fed to the banknote transport path 100, by driving a motor that drives the banknote supply unit 30 and the banknote transport path 100 (the banknote supply/transport unit). At this point in time, the bladed wheel motor 21 may be driven.

When a banknote being transported on the banknote transport path 100 passes the recognition unit 110, the authenticity and the denomination of the banknote are judged (steps S2 and S3). When the banknote is not authentic or is not of a predetermined denomination to be counted, the second gate 122 is operated to transport the banknote to the reject unit 130 via the reject transport path 100*c* (step S4). When the banknote is authentic and is of a predetermined denomination, control proceeds to step S5 to drive the bladed wheel motor 21. When the bladed wheel motor has been already driven at step S1, drive at this point in time is not necessary.

Next, at step S6, it is judged whether a predetermined number of banknotes, in this example, 100 banknotes have passed the banknote counting sensor CS, and when the banknotes have passed, the banknote supply unit 30, the banknote transport path (the banknote supply/transport unit) 100, and the bladed wheel motor are stopped (step S7).

Next, at step S8, it is judged whether any of the banknote-presence detection sensors S1, S2, and S3 has detected banknotes. When any sensor has detected banknotes, it is judged whether the banknote-presence detection sensors S1 and S2, whose detection target is the stacking area SA, has not detected banknotes, and only the banknote-presence detection sensor S3, whose detection target is the extraction area 80, has detected banknotes, at step S9. When only the banknote-presence detection sensor S3 has detected banknotes, since there is no banknote in the stacking area SA, control shifts to step S1 in order to start transport and counting of the next 100 banknotes. Further, in the case of NO at step S9, it is judged whether all the sensors S1, S2, and S3 have detected banknotes at step S10. When all the sensors have detected banknotes, control waits for pullout of the banknotes from the extraction area 80 (step S11). When the banknotes are pulled out (YES at step S12), control proceeds to step S15 to drive the stacking tray motor 71, thereby rotating the stacking tray 50 by 180 degrees. Accordingly, the first stacking part 51 (holding a banknote batch) being located in the stacking area SA moves toward the extraction area 80, and the second stacking part 61 (not holding a banknote batch) being located in the extraction area 80 until then moves toward the stacking area SA.

In the case of NO at step S10, it is judged whether only the sensors S1 and S2 on the stacking area SA side have detected banknotes at step S13. In the case of NO at step S13, and it is judged that there is no banknote in the extraction area 80, therefore control shifts to step S15 to rotate the stacking tray. In the case of YES at step S13, it means that there is a banknote in the extraction area 80, therefore it is determined that an error has occurred (step S14).

At step S15, the stacking tray is rotated by 180 degrees and stopped at a home position, by judging the home position of the stacking tray 50 based on the result of detection of a home position detection plate 75 provided on the rotary shaft 52 by the photo interrupter 76 provided in the normal transport path 100*a*. At this stage, the counting processing can be resumed.

Subsequently, at step S16, by resuming drive of the banknote supply unit (the banknote supply/transport unit) 30, the banknote transport path (the banknote supply/transport unit) 100, and the bladed wheel motor, transport and counting processing for the subsequent 100 banknotes are resumed.

There is only less than one second since stop of the bladed wheel motor and the like at step S7 until resuming the processing at step S16.

As described above, the paper sheet stacking method (the paper sheet processing method) according to the present embodiment is characterized such that a paper sheet supply operation by the paper sheet supply/transport unit and a paper sheet emitting operation by the bladed wheel are stopped when a predetermined number of paper sheets are stacked on the first stacking part 51 being at the paper sheet stacking position P1, and the paper sheet supply operation and the paper sheet emitting operation are resumed when the stacking tray is rotated by a predetermined angle and the second stacking part 61 is moved to the paper sheet stacking position.

According to the banknote processing device 1 and the paper sheet stacking method (the paper sheet processing method) by the paper sheet processing device 1 of the present invention having the configuration described above, only one banknote is held in one holding space 17 of the bladed wheel and a plurality of banknotes are not held therein. Therefore, collision or jam of banknotes does not occur in one holding space. Further, since one banknote held in one holding space is sequentially emitted to the stacking area SA before the banknote is circularly moved to the banknote supply position 100A at which the banknote is supplied to the holding space, the stacking order of banknotes stacked on the stacking parts 51 and 61 always matches with the order at the time of supplying the banknotes. Therefore, the banknote processing device 1 and the paper sheet stacking method are suitable when a mechanism in which a serial number of banknotes supplied from the banknote supply unit 30 is sequentially read for each banknote and recorded and used in the order of transport is adopted.

Further, the second stacking part 61 in a vacant state can be transferred to the stacking area SA by rotating the stacking tray 50 when a predetermined number of banknotes have been stacked on the first stacking part 51. Therefore, subsequent banknotes can be stacked continuously, separated from a banknote batch in the extraction area, without manually taking out the banknote batch stacked in the stacking area SA. Since banknote supply to the bladed wheel and banknote emission from the bladed wheel to the stacking area SA are stopped only for a time required for rotating the stacking tray 50, which is about less than one second, the downtime is short and the counting operation of a large number of banknotes can be efficiently performed.

In the present embodiment, since one stacking tray includes two stacking parts 51 and 61, two banknote batches can be held simultaneously, and even if an already stacked banknote batch is present in the extraction area 80, stacking in the stacking area SA is possible concurrently. Therefore, there is no disadvantage or inconvenience such that the already stacked banknote batch needs to be taken out immediately in order to start the next counting. Accordingly, workers can ensure a time to spare for performing other operations such as taking out a banknote batch from the extraction area 80 and bundling during the counting operation.

[1-2: Modification]

Figure 9A:
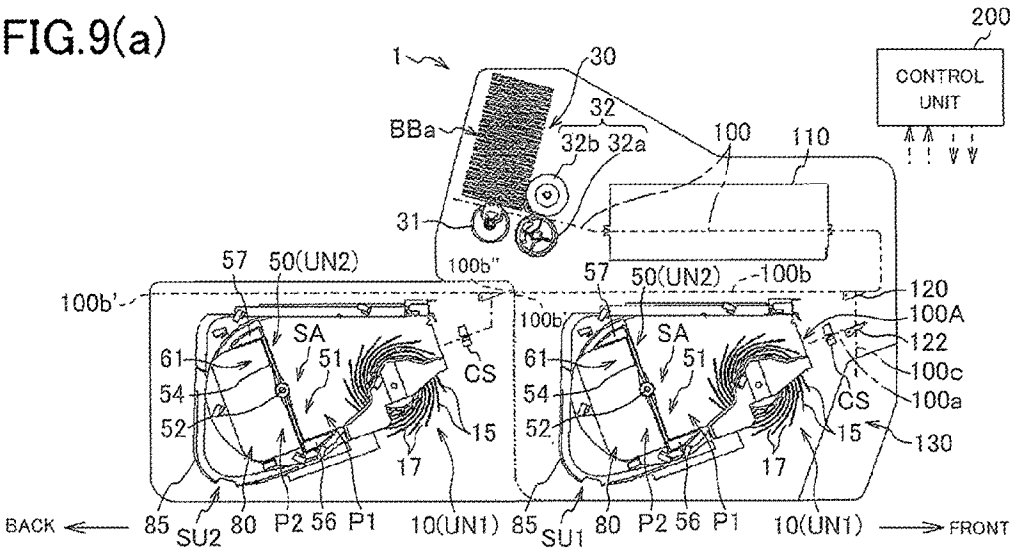
FIGS. 9(*a*) and (*b*) are diagrams illustrating a configuration example in a case where a plurality of stacker units are connected in a banknote processing device according to a first embodiment.
Figure 9B:
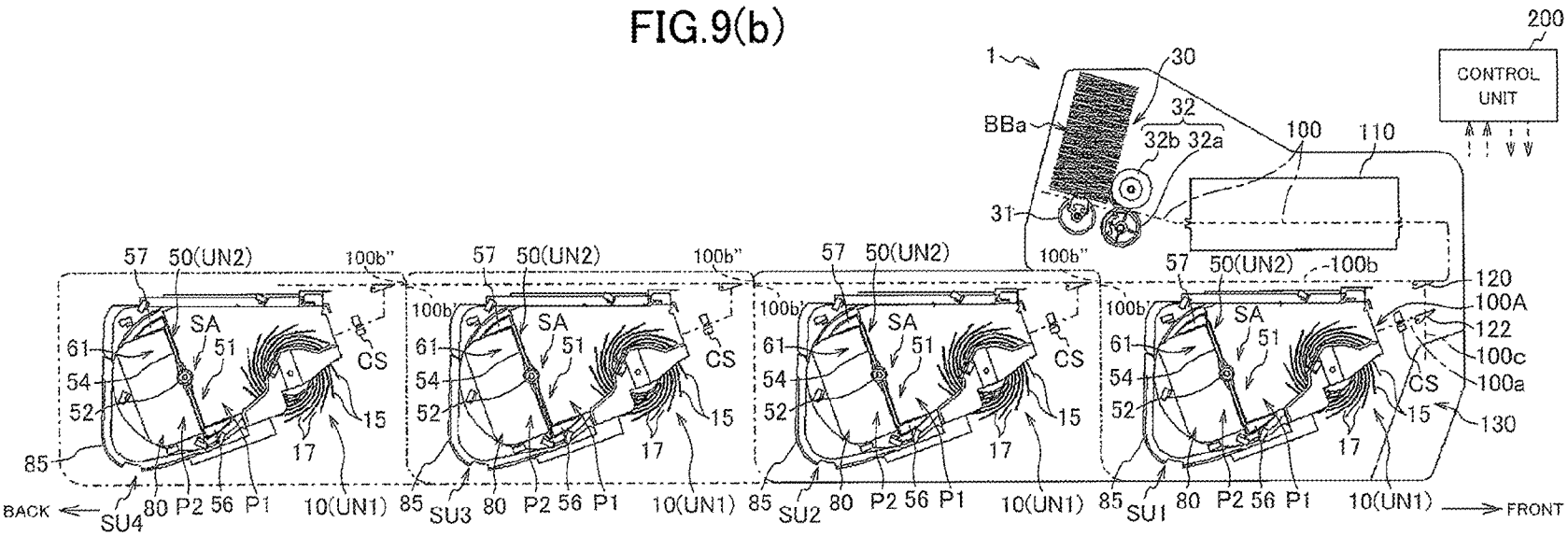
Figure 10A:
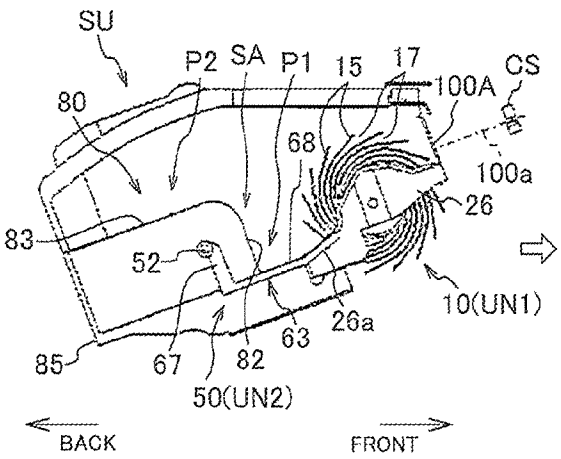
FIGS. 10(*a*) to (*e*) are diagrams for explaining an internal configuration and an operation procedure of a banknote processing device according to a second embodiment.
Figure 10B:
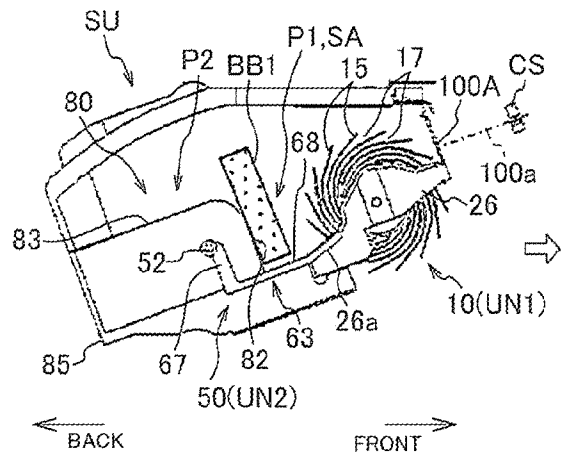
Figure 10C:
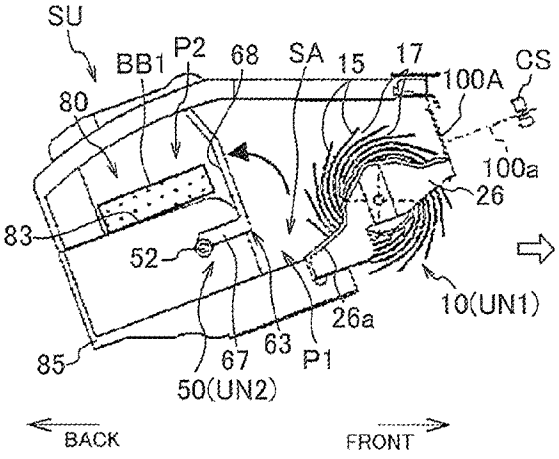
Figure 10D:
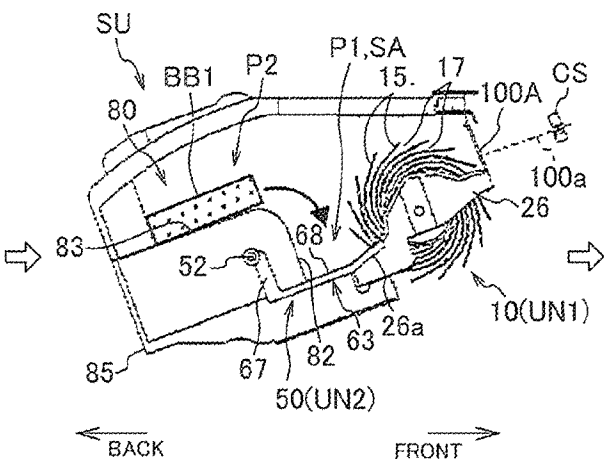
Figure 10E:
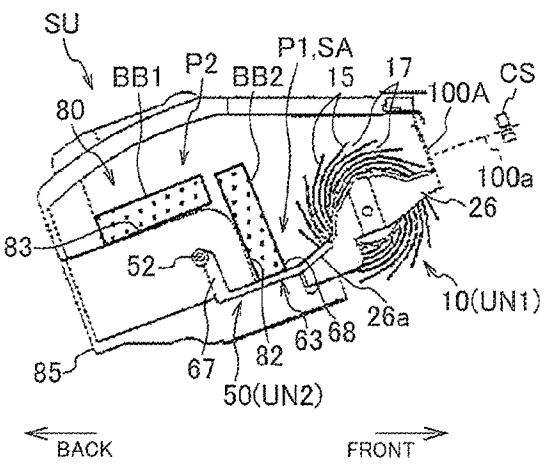
Figure 11A:
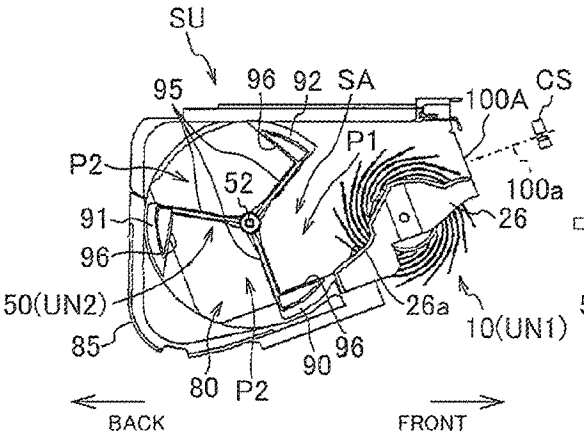
FIGS. 11(*a*) to (*f*) are diagrams for explaining an internal configuration and an operation procedure of a banknote processing device according to a third embodiment.
Figure 11B:
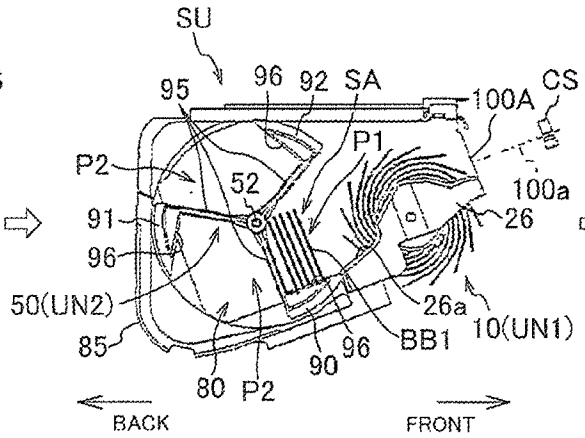
Figure 11C:
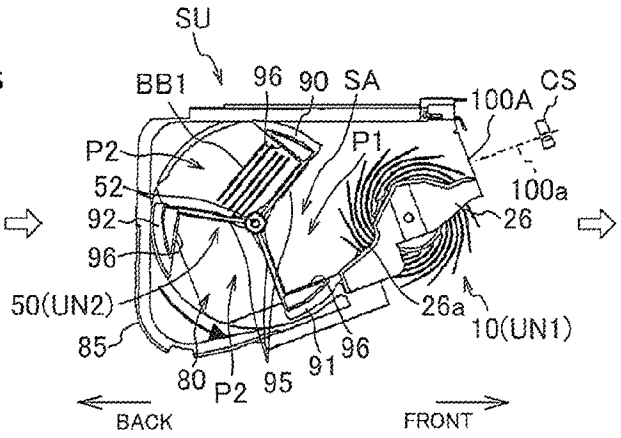
Figure 11D:
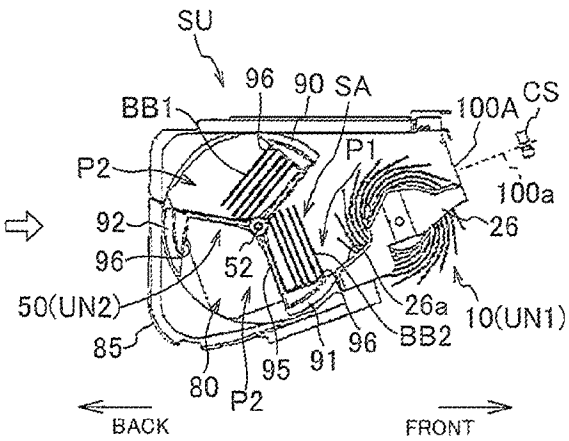
Figure 11E:
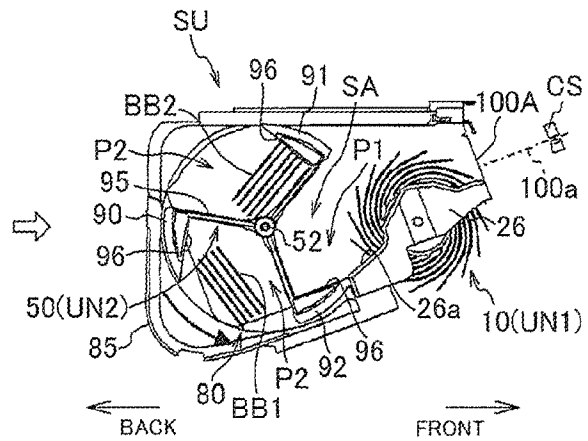
Figure 11F:
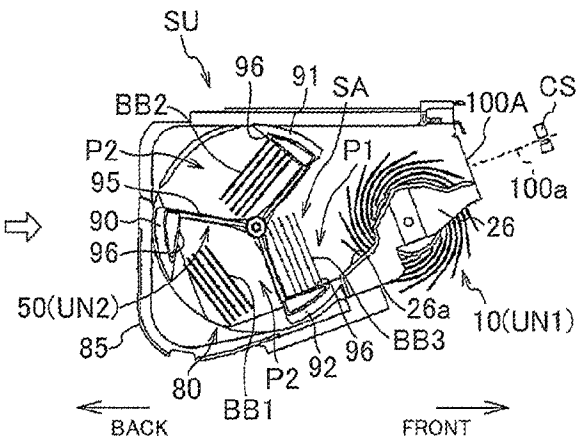

FIGS. 9(*a*) and (*b*) illustrate a configuration example in a case where a plurality of stacker units are connected in the banknote processing device according to the first embodiment. With reference to the basic configuration of the banknote processing device in FIGS. 1 to 4 and the basic configuration of the stacker unit in FIG. 5, identical parts as those in the first embodiment are denoted by like reference signs and explanations of redundant configurations and operations are omitted.

As described with reference to FIG. 1, the banknote transport path 100 of the banknote processing device 1 includes the diverted transport path 100*b* extending in parallel with the normal transport path 100*a* on the upstream side of the normal transport path. The diverted transport path 100*b* is diverted from a route toward the normal transport path 100*a* by the first gate 120 and is extended rearward along the upper part of the bladed wheel and the stacking tray.

FIG. 9(*a*) illustrates a state in which a second stacker unit SU2 is connected to a side surface of a first stacker unit SU1 (outside of the extraction area 80) regularly provided in the banknote processing device 1. Although detailed descriptions of a connection mechanism are omitted, the stacker units are configured to be connectable with each other by a screw or the like. The configurations of the first stacker unit SU1 and the second stacker unit SU2 are substantially the same. As illustrated in FIG. 9(*a*), these stacker units are configured in such a manner that an ejecting part 100*b*' provided at a terminal end of the diverted transport path 100*b* in the first stacker unit SU1 becomes continuous to a receiving part 100*b*" provided at a starting point of the diverted transport path 100*b* in the second stacker unit SU2 so that transported banknotes can be smoothly transferred at the time of connecting the two stacker units. Since the ejecting part 100*b*' is provided also at the terminal end of the diverted transport path 100*b* in the second stacker unit SU2, another stacker unit can be connected thereto.

According to the device configuration illustrated in FIG. 9(*a*), even if the first and second stacking parts 51 and 61 of the stacking tray 50 in the first stacker unit SU1 are in a full state with the stacked banknotes, subsequent banknotes can be counted and stacked continuously by using the second stacker unit SU2 by switching the first gate 120 that has opened the normal transport path 100*a* so as to open the diverted transport path 100*b*, without taking out a stacked banknote batch in the extraction area 80. Therefore, workers can ensure a longer time to spare for performing manual operations associated with bundling, counting, and the like.

It suffices that the reject unit 130 is provided only in the first stacker unit SU1, and the reject unit 130 is not necessarily provided in the second stacker unit SU2, the third stacker unit SU3, and thereafter to be connected thereto.

Since the second stacker unit SU2 and other stacker units SU3 and SU4 to be connected illustrated in FIG. 9(*b*) have the same configuration, any number of stacker units can be connected as illustrated in FIG. 9(*b*).

Since the stacker unit itself is downsized, even if a plurality of stacker units are connected, an occupied area is not increased so much.

Second Embodiment

FIGS. 10(*a*) to (*e*) are diagrams for explaining an internal configuration and an operation procedure of a banknote processing device according to a second embodiment. With reference to the basic configuration of the banknote processing device in FIGS. 1 to 4 and the basic configuration of the stacker unit in FIG. 5, identical parts as those in the first embodiment are denoted by like reference signs and explanations of redundant configurations and operations are omitted.

The banknote processing device 1 according to the second embodiment includes the stacking tray 50 having a different configuration from that of the first embodiment.

That is, the banknote processing device 1 according to the second embodiment includes the bladed wheel 10, the banknote (paper sheet) supply unit 30, the stacking tray 50, the stacked banknote (paper sheet) extraction area 80, and the control unit 200. The stacking tray 50 includes a single stacking part 63 that is turned in forward and reverse directions (rotated in forward and reverse directions) around the rotary shaft 52 between the banknote stacking position (banknote stacking posture) P1 facing the bladed wheel and the non-stacking position (non-stacking posture) P2 not facing the bladed wheel. The single stacking part 63 continues to stack banknotes when at the banknote stacking position until the emitted banknotes reach a predetermined number of sheets, and when stacking up to the predetermined number of sheets is complete, is rotated in the forward direction to move to the non-stacking position P2, thereby ejecting the banknote batch BB stacked on the stacking part 63 to the banknote-batch extraction area 80. After ejection of the stacked banknote batch to the banknote-batch extraction area 80, the stacking part 63 is rotated in the reverse direction to return to the banknote stacking position P1 and prepare for stacking of the next banknotes.

That is, according to the second embodiment, the two stacking parts 51 and 61 are not provided in the stacking tray 50, having the rotary shaft 52 therebetween as in the first embodiment, and only one stacking part 63 is provided. The stacking part 63 stacks a banknote batch at the stacking position, and after stacking completion, is rotationally moved to the non-stacking position P2 around the rotary shaft 52, to eject the stacked banknote batch to the banknote-batch extraction area 80. After ejection, the stacking part 63 is rotated in the reverse direction to return to the original stacking position.

The stacking tray 50 according to the present example has a front shape substantially in an L shape, and includes a short arm 67 extending from the rotary shaft 52, and a banknote placing plate 68 bent by 90 degrees and extending from a tip end of the arm 67. The banknote placing plate 68 configures the stacking part 63.

The stacking tray is turned between an initial state (the banknote stacking position P1) illustrated in FIG. 10(*a*) and the non-stacking position P2 illustrated in FIG. 10(*c*) by a turning movement of the rotary shaft 52 driven by the stacking tray motor 71 (not illustrated).

In the initial state illustrated in FIG. 10(*a*), the banknote placing plate 68 maintains a substantially horizontal posture at the banknote stacking position P1, and receives banknotes emitted one by one from the bladed wheel 10 on an upper surface and stacks the banknotes thereon (FIG. 10(*b*)) when at the banknote stacking position. That is, when the stacking part 63 is at the banknote stacking position P1 as illustrated in FIG. 10(*a*), banknotes are supplied to each banknote holding space 17 of the bladed wheel one by one and held therein by driving the banknote supply unit 30, the banknote transport path 100, the bladed wheel motor 21, and the stacking tray motor 71 (all not illustrated). The banknote in the banknote holding space comes into contact with the upper surface 26*a* of the bladed wheel guide 26 in a process of rotation of the bladed wheel, thereby being ejected from the banknote holding space and emitted to the stacking area SA, and sequentially stacked on the stacking part 63 at the banknote stacking position P1 in a standing state. When a predetermined number of sheets are stacked, the stacking tray 50 is turned by 90 degrees upward as illustrated in FIG. 10(*c*), thereby emitting a stacked banknote batch BB1 to the extraction area 80. That is, by turning the rotary shaft 52 by 90 degrees in an upward direction from the state illustrated in FIG. 10(*b*), the banknote placing plate 68 becomes a substantially vertical posture to emit the stacked banknote batch BB1 held thereon onto the extraction area 80 (a banknote batch holding surface 83) (FIG. 10(*c*)).

After emitting the stacked banknote batch to the extraction area, by rotating the stacking tray motor in the reverse direction, the stacking tray 50 is returned to the original banknote stacking position P1 to wait for next stacking of banknotes (FIG. 10(*d*)). As illustrated in FIG. 10(*e*), even if the stacked banknote batch BB1 emitted onto the extraction area 80 remains thereon, subsequent banknotes can be continuously stacked on the stacking part 63 at the banknote stacking position P1. The reference sign BB2 represents the subsequent stacked banknote batch.

After the banknote-presence detection sensor S3 (not illustrated) detects that the stacked banknote batch BB1 emitted onto the extraction area 80 has been taken out, the stacked banknote batch BB2 can be moved onto the extraction area 80 by turning the stacking tray 50 upward by 90 degrees.

A rear-surface support part 82 that supports a rear surface of the banknote batch BB1 held in a standing state on the banknote placing plate 68 (the stacking part 63) is arranged in the stacking area SA, and a flat banknote-batch holding surface configuring the extraction area 80 is provided above and behind the rear-surface support part 82.

According to the banknote processing device 1 according to the second embodiment having the configuration described above, since a plurality of banknotes are not held in one holding space 17 of the bladed wheel as in the first embodiment, collision or jam of banknotes can be prevented. Further, the stacking order of banknotes to be stacked on the stacking part always matches with the order at the time of supplying the banknotes. Therefore, the banknote processing device 1 is suitable when a mechanism in which a serial number of banknotes supplied from the banknote supply unit 30 is sequentially read for each banknote and recorded and used in the order of transport is adopted.

Further, since the stacking tray 50 is rotated to eject the banknotes to the extraction area 80 and is immediately returned to the banknote stacking position P1 at a point in time when a predetermined number of banknotes are stacked on the stacking part 63, subsequent banknotes can be stacked continuously, separated from a banknote batch in the extraction area, without manually taking out the banknote batch stacked in the stacking area SA. Banknote supply to the bladed wheel is stopped only for a time required for rotating the stacking tray 50 by 90 degrees which is only about 0.5 second. Accordingly, the downtime is short and the counting operation of a large number of banknotes can be efficiently performed.

Since the stacking part 63 can return to the banknote stacking position even immediately after ejection of the stacked banknote batch to the extraction area 80 by a quick reciprocating operation by one stacking part 63, stacking in the stacking area SA can be resumed without any interruption. Therefore, there is no disadvantage or inconvenience such that the already stacked banknote batch needs to be taken out immediately from the extraction area in order to start the next counting. Accordingly, workers can ensure a time to spare for performing other operations such as taking out a banknote batch from the extraction area 80 and bundling during the counting operation.

Figure 8:
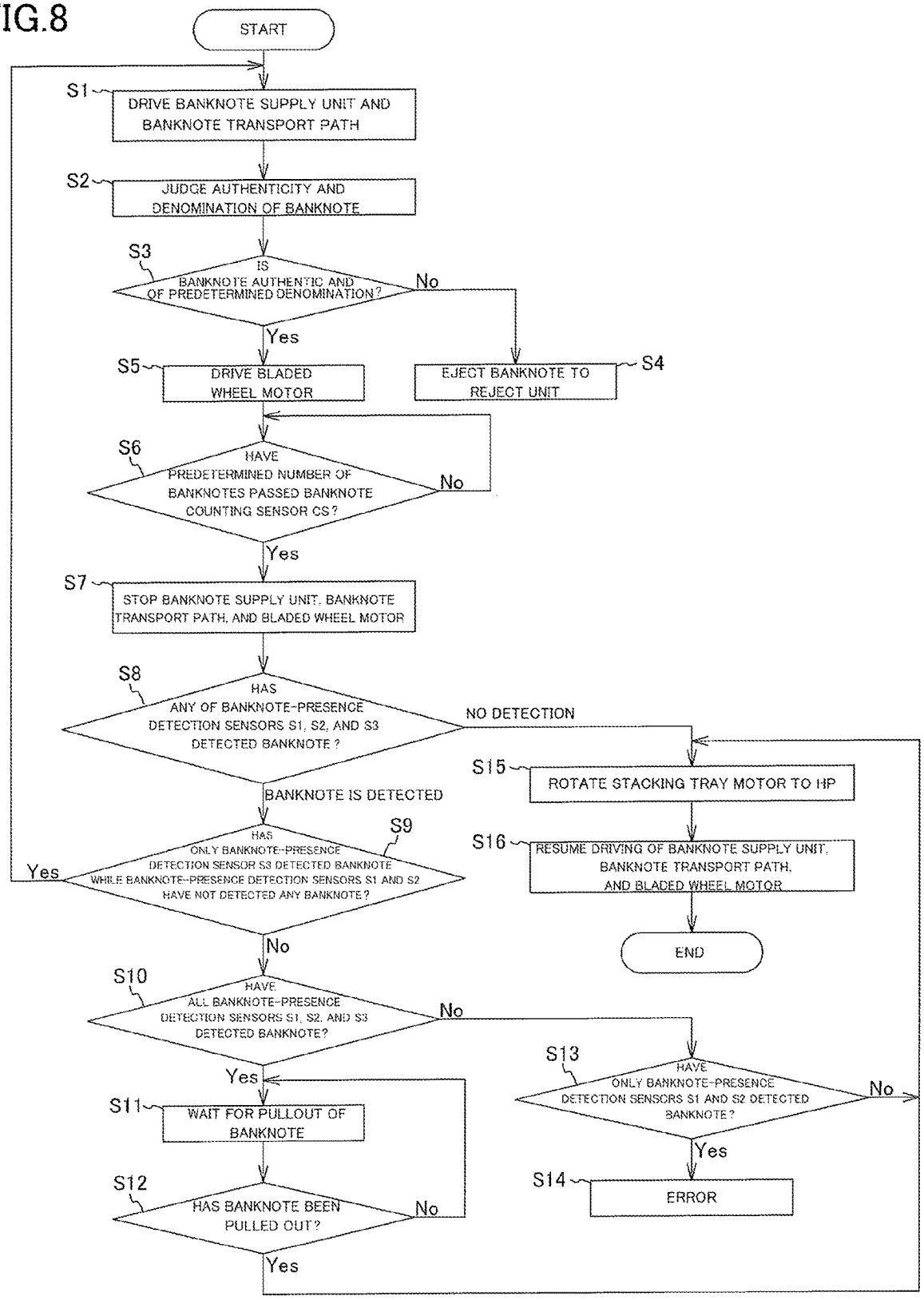
FIG. 8 is a flowchart illustrating a banknote counting procedure by the banknote processing device of the present invention.

The processing procedure for counting and stacking is the same as that illustrated in the flowchart in FIG. 8, and thus explanations thereof are omitted.

The configuration in which plural stacker units SC are connected with each other as illustrated in FIG. 9 can be also applied to the present embodiment.

Third Embodiment

FIGS. 11(*a*) to (*f*) are diagrams for explaining an internal configuration and an operation procedure of a banknote processing device according to a third embodiment. With reference to the basic configuration of the device in FIGS. 1 to 4 and the basic configuration of the stacker unit in FIG. 5, identical parts as those in the first embodiment are denoted by like reference signs and explanations of redundant configurations and operations are omitted.

The banknote processing device 1 according to the third embodiment includes the stacking tray 50 having a different configuration from that of the first embodiment.

The stacking tray according to the first embodiment includes two stacking parts 51 and 61 arranged with a circumferential interval of 180 degrees. However, the stacking tray 50 according to the present example includes three stacking parts 90, 91, and 92 arranged with a circumferential interval of 120 degrees. The three stacking parts 90, 91, and 92 are arranged so as to be circumferentially moved to the banknote stacking position P1 in this order when the stacking tray is rotated in a counter-clockwise direction.

The stacking tray 50 includes three base plates 95 projecting radially from the rotary shaft 52 with a circumferential interval of 120 degrees, and three bottom plates 96 connected to the tip end of each base plate and bent by about 90 degrees. A combination of each base plate 95 and each bottom plate 96 configures each stacking part 90, 91, or 92.

As illustrated in FIG. 11(*a*), when the first stacking part 90 is at the banknote stacking position P1, banknotes are supplied to each banknote holding space 17 of the bladed wheel one by one from the banknote supply position 100A and held therein by driving the banknote supply unit 30, the banknote transport path 100, the bladed wheel motor 21, and the stacking tray motor 71 (all not illustrated). The banknote in the banknote holding space comes into contact with the upper surface 26*a* of the bladed wheel guide 26 in the process of rotation of the bladed wheel, thereby being ejected from the banknote holding space and emitted to the stacking area SA, and sequentially stacked on the first stacking part 90 at the banknote stacking position P1 in a standing state. When a predetermined number of sheets are stacked on the first stacking part 90, the stacking tray 50 is turned by 120 degrees upward as illustrated in FIG. 11(*c*) and is stopped. At this time, the second stacking part 91 being at the non-stacking position P2 (the extraction area 80) until then moves to the banknote stacking position P1 and stops. Therefore, banknotes emitted from the bladed wheel are sequentially stacked on the second stacking part 91 according to the same procedure described above (FIG. 11(*d*)). When stacking of a predetermined number of banknotes on the second stacking part 91 is complete, the stacking tray 50 is turned by 120 degrees upward as illustrated in FIG. 11(*e*) and is stopped. At this time, the third stacking part 92 being at the non-stacking position P2 (the extraction area 80) until then moves to the banknote stacking position P1 and stops.

In FIG. 11(*e*), since the stacked banknote batch BB1 in the first stacking part 90 is located in the extraction area 80, the stacked banknote batch BB1 can be taken out from outside. However, as illustrated in FIG. 11(*f*), even if the stacked banknote batch BB1 in the first stacking part 90 is not taken out, banknotes from the bladed wheel can be stacked on the third stacking part 92 at the banknote stacking position P1.

According to the banknote processing device 1 according to the third embodiment having the configuration described above, since a plurality of banknotes are not held in one holding space 17 of the bladed wheel as in the first embodiment, collision or jam of banknotes does not occur in one holding space. Further, the stacking order of banknotes to be stacked on the stacking part always matches with the order at the time of supplying the banknotes. Therefore, the banknote processing device 1 is suitable when a mechanism in which a serial number of banknotes supplied from the banknote supply unit 30 is sequentially read for each banknote and recorded and used in the order of transport is adopted.

Further, at a time point when a predetermined number of banknotes are stacked on one stacking part 90 among the three stacking parts 90, 91, and 92, the stacking tray 50 is rotated by 120 degrees in one direction to hold the stacked banknote batch BB1 in the first stacking part 90 at a holding position, whereas the next second stacking part 91 is moved to the banknote stacking position P1 to continuously perform stacking of subsequent banknotes. At a time point when stacking of banknotes on the second stacking part 91 is complete, the stacking tray 50 is further turned in the same direction by 120 degrees to bring the third stacking part 92 to the banknote stacking position, and simultaneously therewith, the first stacking part 90 holding the stacked banknote batch BB1 is transferred to the extraction area 80. Therefore, the stacked banknote batch can be taken out from the extraction area. However, even if the stacked banknote batch is not taken out, subsequent banknotes can be stacked on the third stacking part 92. In this manner, since the three stacking parts are continuously and sequentially moved to the banknote stacking position P1, subsequent banknotes can be stacked continuously, separated from the banknote batch in the extraction area, without manually taking out the stacked banknote batch moved to the extraction area. Banknote supply to the bladed wheel is stopped only for a time required for rotating the stacking tray 50 by 120 degrees which is only about 0.5 second. Accordingly, the downtime is short and the counting operation of a large number of banknotes can be efficiently performed.

Since each stacking part can return to the banknote stacking position P1 even immediately after ejection of the stacked banknote batch to the extraction area 80 by the quick and continuous rotary motion of the three stacking parts 90, 91, and 92, stacking of banknotes can be resumed on the stacking area SA side without any interruption. Therefore, there is no disadvantage or inconvenience such that the already stacked banknote batch needs to be taken out immediately from the extraction area in order to start the next counting. Accordingly, workers can ensure a time to spare for performing other operations such as taking out a banknote batch from the extraction area 80 and bundling during the counting operation.

The processing procedure for counting and stacking is the same as that illustrated in the flowchart in FIG. 8, and thus explanations thereof are omitted.

The configuration in which plural stacker units SC are connected with each other as illustrated in FIG. 9 can be also applied to the present embodiment.

<Summary of Configuration, Action, and Effects of Present Invention>

The paper sheet processing device 1 according to a first invention includes the bladed wheel 10 that includes the rotary shaft 11, a plurality of the blades 15 projecting radially around the rotary shaft, and the paper sheet holding space 17 formed between the blades adjacent to each other in the circumferential direction to hold one received paper sheet so as to take in and out the paper sheet freely, and sequentially emits one paper sheet each held in each paper sheet holding space to the predetermined stacking area SA at the time of rotation in one direction. The paper sheet processing device 1 further includes the paper sheet supply/transport unit 30, 100 that supplies paper sheets one by one to each of the paper sheet holding spaces of the rotating bladed wheel, the stacking tray 50 arranged in the stacking area SA to hold (stack) thereon paper sheets emitted from each of the paper sheet holding spaces one by one in a stacked state and rotates around a rotary shaft, the stacked paper sheet-batch extraction area 80, which is a transfer destination of a batch of paper sheets stacked on the stacking tray and stores therein the batch of paper sheets in a state capable of taking out the batch of paper sheets to outside, the drive mechanism 20, 70, and the control unit 200 that controls the drive mechanism and other control targets. The stacking tray 50 includes at least the first stacking part (the stacking part) 51, 90 that stacks thereon emitted paper sheets when at the paper sheet stacking position (paper sheet receiving posture) P1 facing the bladed wheel and is rotationally moved to the non-stacking position P2 not facing the bladed wheel when a predetermined number of paper sheets are stacked thereon, and the second stacking part 61, 91 that is moved to the paper sheet stacking position to stack thereon emitted paper sheets when being rotated by a predetermined angle from the non-stacking position not facing the bladed wheel, and is rotationally moved to the non-stacking position when a predetermined number of paper sheets are stacked thereon. The first stacking part and the second stacking part are located in the stacked paper sheet-batch extraction area 80 when each part is at the non-stacking position.

The stacking tray 50 including a plurality of stacking parts for stacking thereon paper sheets emitted from the bladed wheel one by one is arranged in the stacking area SA, and the stacking tray is rotated by a predetermined angle to move either stacking part sequentially to the paper sheet stacking position P1 and stop the stacking part, thereby stacking a predetermined number of paper sheets on each stacking part. Immediately after stacking on one stacking part is complete, the stacking tray is rotated by a predetermined angle to evacuate one stacking part from the paper sheet stacking position to the non-stacking position, and to move another stacking part being at the non-stacking position until then to the paper sheet stacking position. The other stacking part moved to the paper sheet stacking position can start stacking of paper sheets immediately. Accordingly, the downtime of the processing is short, and a batch of stacked paper sheets and another batch of paper sheets stacked subsequently can be separated from each other and stacked.

When the stacking tray is configured in a rotationally symmetric shape, the stacking tray is rotated by 180 degrees to evacuate one stacking part that is holding a batch of stacked paper sheets to the non-stacking position, and simultaneously, the other stacking part that is not holding paper sheets is moved to the paper sheet stacking position. Therefore the stacking tray is always in a state capable of continuing stacking.

That is, if a batch of stacked paper sheets on one stacking part is removed while the other stacking part on the other side being rotationally symmetric is moved to the paper sheet stacking position to stack subsequent paper sheets (before the predetermined number of subsequent paper sheets are stacked) by evacuating a batch of stacked paper sheets held in one stacking part to the non-stacking position, the counting and stacking processing can be performed continuously. When it is desired to stack a large number of paper sheets without interruption for a long time, it suffices that after a batch of paper sheets stacked first is moved to the extraction area, stacking of subsequent paper sheets at the paper sheet stacking position is continued without removing the batch of stacked paper sheets.

After a batch of the predetermined number of stacked paper sheets is moved to the extraction area 80, subsequent paper sheets can be processed while reducing the downtime of processing. Therefore, the efficiency of counting and stacking processing of paper sheets can be improved as a whole. Since a user can continue the counting and stacking processing without immediately removing the batch of stacked paper sheets from the extraction area 80, not only complexity is reduced, but also processing to remove the stacked batch in the extraction area can be continued.

In paper sheet counting devices in recent years, improvement in the processing efficiency has been desired, and it is required to reduce the waiting time caused when processing is temporarily interrupted while waiting for removal of a batch of stacked paper sheets. This issue can be solved according to the present invention.

Since two batches of a predetermined number of paper sheets can be stacked on one stacking tray simultaneously, a plurality of stacker units do not need to be provided and the size and the cost of the device are not increased.

Further, a batch of a predetermined number of paper sheets and the subsequent batch of paper sheets can be separated from each other stably and reliably without causing any trouble such as jam between the blades of the bladed wheel.

Further, since paper sheets can be stacked on the stacking tray in the order of supply and transport of the paper sheets by the paper sheet supply unit 30, 100, read sequence information of serial numbers acquired at the time of feeding paper sheets can be matched with the stacking order of the batch of stacked paper sheets.

The first invention includes not only a case in which the stacking tray includes two stacking parts, but also a case in which the stacking tray includes three or more stacking parts.

Further, the control unit 200 stops a paper sheet supply operation by the paper sheet supply unit 30, 100 and a paper sheet emitting operation by the bladed wheel when a predetermined number of paper sheets are stacked on the first stacking part 51, 90 being at the paper sheet stacking position P1, and resumes the paper sheet supply operation and the paper sheet emitting operation when the second stacking part 61, 91 is moved to the paper sheet stacking position by rotating the stacking tray by a predetermined angle.

In addition to the device configuration described above, by performing stop of the paper sheet emitting operation or the like and restart of the paper sheet emitting operation or the like thereafter, the control unit can resume the counting and stacking processing only with a minimum necessary downtime.

In the conventional paper sheet counting device, unless a batch of paper sheets stacked and ejected to an extraction position is extracted, the next stacking operation cannot be continued. However, in the present invention, the stacking operation can be resumed by waiting for a quite short time required for the stacking tray to rotate, without taking out the batch of paper sheets.

In a paper sheet processing device according to a second invention, the control unit 200 causes paper sheets supplied from the paper sheet supply unit 30, 100 one by one to be held one each in one paper sheet holding space 17, thereby arranging paper sheets emitted from the paper sheet holding space and stacked on the first stacking part or the second stacking part in the order of supply of the paper sheets from the paper sheet supply unit.

One paper sheet held in the paper sheet holding space is securely ejected to the stacking area in the middle of circling 360 degrees, and does not return to the paper sheet supply position 100A after circling. Therefore, a plurality of paper sheets are not accommodated in one paper sheet holding space.

Paper sheets are held in each paper sheet holding space 17 in the order of feed of the paper sheets, and the held paper sheets are emitted to the stacking area supply and stacked therein in the same order as the order of feed in the process of rotation of the bladed wheel. Accordingly, the paper sheets can be stacked on the stacking tray in the order of supply of the paper sheets from the paper sheet supply unit.

In a paper sheet processing device according to a third invention, a predetermined angle when the stacking tray 50 rotates is 180 degrees or 120 degrees.

When two stacking parts are arranged by forming the stacking tray in a rotationally symmetric shape, the positional relation of each stacking part is switched by rotation of the bladed wheel by 180 degrees. Further, when three stacking parts are arranged in the stacking tray, the positional relation of each stacking part is switched by rotation of the bladed wheel by 120 degrees.

By having a configuration including three stacking parts, a stacking duration time by one paper sheet processing device can be extended than a case of including two stacking parts.

A paper sheet processing device according to a fourth invention includes the bladed wheel 10 that includes the rotary shaft 11, a plurality of blades projecting radially around the rotary shaft, and the paper sheet holding space 17 formed between blades adjacent to each other in the circumferential direction to hold one received paper sheet so as to take in and out the paper sheet freely, and sequentially emits one paper sheet each held in each paper sheet holding space to the predetermined stacking area supply at the time of rotation in one direction. The paper sheet processing device further includes the paper sheet supply unit 30, 100 that supplies paper sheets one by one to each of the paper sheet holding spaces of the rotating bladed wheel, the stacking tray 50 arranged in the stacking area to hold thereon paper sheets emitted from each of the paper sheet holding spaces one by one in a stacked state and rotates around a rotary shaft, the stacked paper sheet-batch extraction area 80, which is a transfer destination of a batch of paper sheets stacked on the stacking tray and stores therein the batch of paper sheets in a state capable of taking out the batch of paper sheets to outside, the drive mechanism 20, 70, and the control unit 200 that controls various control targets. The stacking tray includes the stacking part 63 that stacks thereon emitted paper sheets when at the paper sheet stacking position facing the bladed wheel and is rotationally moved in a reverse direction to a non-stacking position not facing the bladed wheel when a predetermined number of paper sheets are stacked thereon. The stacking part moves to the non-stacking position to eject a batch of stacked paper sheets on the stacking part to the stacked paper sheet-batch extraction area, and returns to the paper sheet stacking position after completion of the ejection.

The paper sheet processing device according to the fourth invention corresponds to the embodiment illustrated in FIG. 10, and exerts the same actions and effects as those of the paper sheet processing device according to the first invention. The different point from the first paper sheet processing device is that the paper sheet processing device according to the fourth invention includes only one stacking part. Counting and stacking processing can be performed efficiently in the same manner as the device configuration according to claim 1 and stacking of subsequent paper sheets can be continued in a state in which the stacked paper sheets are left in the extraction area, also by causing the single stacking part to perform forward rotation and reverse rotation, thereby reciprocating the stacking part between the paper sheet stacking position P1 and the non-stacking position P2. Since only one stacking part is provided and the turning angle range can be decreased to about 90 degrees, a time required since the stacking tray is rotated in the forward direction and then in the reverse direction until the stacking tray is returned to the stacking position can be reduced. Further, since the configuration in which the stacking tray is rotated by 360 degrees in the same direction as in claim 1 is not adopted, the device can be downsized.

Further, the control unit 200 stops the paper sheet supply operation by the paper sheet supply/transport unit and the paper sheet emitting operation by the bladed wheel when stacking of a predetermined number of paper sheets on the stacking part 63 being at the paper sheet stacking position P1 is complete. Thereafter, after rotationally moving the stacking part to the non-stacking position P2 to eject the batch of stacked paper sheets on the stacking part to the stacked paper sheet-batch extraction area 80, the control unit 200 rotates the stacking part in the reverse direction to return to the paper sheet stacking position, thereby resuming the paper sheet supply operation and the paper sheet emitting operation.

By stopping the paper sheet emitting operation and the like and resuming the paper sheet emitting operation and the like thereafter, the counting and stacking processing can be performed with a minimum necessary downtime.

A stacking tray according to a fifth invention is a stacking tray in the paper sheet processing device that includes the bladed wheel 10 that sequentially emits one paper sheet B each held in the paper sheet holding space 17 to the predetermined stacking area SA at the time of rotation in one direction, and the stacking tray 50 arranged in the stacking area to hold thereon paper sheets emitted from each of the paper sheet holding spaces one by one in a stacked state and rotates around a rotary shaft. The stacking tray includes at least the first stacking part 51 that is rotationally moved between the paper sheet stacking position P1 facing the bladed wheel and the non-stacking position P2 not facing the bladed wheel, and the second stacking part 61 that is turnably moved between the non-stacking position not facing the bladed wheel and the paper sheet stacking position facing the bladed wheel.

The stacking tray corresponds to the stacking tray according to the first and third embodiments, and exerts actions and effects corresponding to the first and third inventions, when incorporated in the paper sheet processing device 1.

A stacking tray according to a sixth invention is a stacking tray in the paper sheet processing device that includes the bladed wheel 10 including the paper sheet holding spaces 17 and the stacking tray 50 arranged in the stacking area SA to hold thereon paper sheets emitted from each of the paper sheet holding spaces one by one in a stacked state and rotates around a rotary shaft. The stacking tray includes the stacking part 63 that is rotationally moved in forward and reverse directions between the paper sheet stacking position facing the bladed wheel and the non-stacking position not facing the bladed wheel.

The stacking tray corresponds to the stacking tray according to the second embodiment, and exerts actions and effects corresponding to the fourth invention, when incorporated in the paper sheet processing device 1.

According to a paper sheet stacking method performed by a paper sheet processing device according to a seventh invention, a paper sheet supply operation by the paper sheet supply/transport unit and a paper sheet emitting operation by the bladed wheel are stopped when stacking of a predetermined number of paper sheets on the first stacking part 51 at the paper sheet stacking position P1 is complete, and the paper sheet supply operation and the paper sheet emitting operation are resumed when the stacking tray 50 is rotated by a predetermined angle to move the second stacking part 61 to the paper sheet stacking position.

According to the paper sheet stacking method, by stopping the paper sheet emitting operation and the like and resuming the paper sheet emitting operation and the like thereafter, the counting and stacking processing can be resumed with a minimum necessary downtime.

The conventional paper sheet counting device cannot continue the next stacking operation unless a batch of paper sheets ejected to the extraction position is taken out after finishing counting and stacking. However, according to the method of the present invention, the stacking operation can be resumed only by waiting for a quite short time required for rotation of the stacking tray, without taking out the batch of paper sheets.

According to a paper sheet stacking method performed by a paper sheet processing device according to an eighth invention, a paper sheet supply operation by the paper sheet supply/transport unit and a paper sheet emitting operation by the bladed wheel are stopped when stacking of a predetermined number of paper sheets on the stacking part 63 being at the paper sheet stacking position P1 is complete, and the paper sheet supply operation and the paper sheet emitting operation are resumed when the stacking part is rotationally moved to the non-stacking position to eject a batch of stacked paper sheets on the stacking part to the stacked paper sheet-batch extraction area 80, and then is rotated in a reverse direction to return to the paper sheet stacking position.

According to the paper sheet stacking method, by stopping the paper sheet emitting operation and the like and resuming the paper sheet emitting operation and the like thereafter, the counting and stacking processing can be resumed with a minimum necessary downtime.

The conventional paper sheet counting device cannot continue the next stacking operation, unless a batch of paper sheets ejected to the extraction position is taken out after finishing counting and stacking. However, according to the method of the present invention, the stacking operation can be resumed only by waiting for a quite short time required for rotation of the stacking tray, without taking out the batch of paper sheets.

REFERENCE SIGNS LIST

1 banknote processing device (banknote counting device), 10 bladed wheel, 11 rotary shaft, 12 base, 15 blade, 17 paper sheet holding space, 20 bladed wheel drive mechanism (drive mechanism), 21 bladed wheel motor, 21*a* output gear, 22 middle gear, 23 driven gear, 26 bladed wheel guide, 26*a* upper surface (stopper), SA stacking area (stack area), 30 banknote supply unit (banknote supply/transport unit), 31 feed roller, 32 separation roller pair, 32*a* feed roller, 32*b* brake roller, 50 stacking tray, 51 first stacking part, 52 rotary shaft, 54 base plate, 54*a* first surface, 54*b* second surface, 56, 57 bottom plate, 56*a* banknote support surface, 56*b* outer diameter side surface, 57*a* banknote support surface, 61 second stacking part, 63 stacking part, 67 arm, 68 banknote placing plate, 70 stacking tray drive mechanism (drive mechanism), 71 stacking tray motor, 71*a* output gear, 72 middle gear, 72*a* small gear, 73 driven gear, 75 home-position detection plate, 76 photo interrupter, 80 extraction area, 82 rear-surface support part, 83 banknote-batch holding surface, 85 casing, 90, 91, 92 stacking part, 95 base plate, 96 bottom plate, 100 banknote transport path (banknote supply/transport unit), 100A banknote supply position, 100*a* normal transport path, 100*b*' ejecting part, 100*b* diverted transport path, 100*c* reject transport path, 110 recognition unit, 130 reject unit.

The invention claimed is:

1. A paper sheet processing device comprising:

a bladed wheel configured to include a plurality of blades projecting radially around a rotary shaft for the bladed wheel, and a paper sheet holding space formed between the blades adjacent to each other to hold one received paper sheet, and sequentially emit one paper sheet each held in the paper sheet holding space to a predetermined stacking area at a time of rotation;

a paper sheet supply and transport unit configured to supply paper sheets one by one to each of the paper sheet holding spaces of the bladed wheel which is rotating;

a stacking tray arranged in the stacking area to stack in a standing state thereon paper sheets emitted from each of the paper sheet holding spaces one by one and rotates in one direction around a rotary shaft for the stacking tray to transport a stacked batch of paper sheets;

a stacked paper sheet-batch extraction area, which is a transfer destination of a batch of paper sheets stacked on the stacking tray and stores therein the batch of paper sheets in a state capable of taking out the batch of paper sheets;

a drive mechanism; and a control unit configured to control the drive mechanism, wherein the stacking tray includes at least a first stacking part that stacks in a standing state emitted paper sheets when at a paper sheet stacking position under the rotary shaft for the stacking tray and comprises a first bottom plate being is rotationally moved upward to a non-stacking position located above the rotary shaft for the stacking tray when a predetermined number of paper sheets are stacked thereon to elect the batch of paper sheets, and a second stacking part that is moved to the paper sheet stacking position to stack thereon emitted paper sheets when being rotated by a predetermined angle from the non-stacking position, and comprises a second bottom plate being rotationally moved upward to the non-stacking position when a predetermined number of paper sheets are stacked thereon to eject the batch of paper sheets, and the first stacking part and the second stacking part are located in the stacked paper sheet-batch extraction area when each part is at the non-stacking position, and the stacking tray has a rotationally symmetric shape having a base plate integrated with the rotary shaft for the stacking tray at an intermediate part thereof to support a back surface of the batch of paper sheets, and the first bottom plate and the second bottom plate each projecting from opposite edges on an outer diameter side of the base plate with an angle of about 90 degrees and each comprising a paper sheet support surface supporting a lower end surface of the batch of paper sheets.

2. The paper sheet processing device according to claim 1, wherein the control unit causes paper sheets supplied from the paper sheet supply and transport unit one by one to be held only one each in the one paper sheet holding space, thereby arranging paper sheets emitted from the paper sheet holding space and stacked on the first stacking part or the second stacking part in order of supply of the paper sheets from the paper sheet supply and transport unit.

3. The paper sheet processing device according to claim 1, wherein the predetermined angle when the stacking tray rotates is 180 degrees or 120 degrees.

4. A paper sheet stacking method performed by the paper sheet processing device according to claim 1, wherein a paper sheet supply operation by the paper sheet supply and transport unit and a paper sheet emitting operation by the bladed wheel are stopped when stacking of a predetermined number of paper sheets on the first stacking part being at the paper sheet stacking position is complete, and the paper sheet supply operation and the paper sheet emitting operation are resumed when the stacking tray is rotated by a predetermined angle to move the second stacking part to the paper sheet stacking position.

5. A paper sheet processing device comprising:

a bladed wheel configured to include a plurality of blades projecting radially around a rotary shaft for the bladed wheel, and a paper sheet holding space formed between the blades adjacent to each other to hold one received paper sheet, and sequentially emit one paper sheet each held in the paper sheet holding space to a predetermined stacking area at a time of rotation;

a paper sheet supply and transport unit configured to supply paper sheets one by one to each of the paper sheet holding spaces of the bladed wheel which is rotating;

a stacking tray arranged in the stacking area to stack in a standing state thereon paper sheets emitted from each of the paper sheet holding spaces one by one when at a paper sheet stacking position and rotates in forward and reverse directions up and down around a rotary shaft for the stacking tray;

a rear-surface support part that supports a rear surface of a batch of paper sheets held in a standing state on the stacking tray at a paper sheet stacking position;

a stacked paper sheet-batch extraction area, which is a transfer destination of the batch of paper sheets stacked on the stacking tray, is located behind, opposite to the bladed wheel, with the stacking area in between and stores therein the batch of paper sheets in a state capable of taking out the batch of paper sheets to outside; and a control unit configured to control various control targets, wherein the stacking tray includes a single stacking part that stacks thereon in a standing state emitted paper sheets when at the paper sheet stacking position under the rotary shaft for the stacking tray and is rotationally moved upward to a non-stacking position located above the rotary shaft for the stacking tray when a predetermined number of paper sheets are stacked thereon, and the stacking part moves upward with an angle of about 90 degrees to the non-stacking position to eject a batch of stacked paper sheets on the stacking part to the stacked paper sheet-batch extraction area, and rotates downward with an angle of about 90 degrees to returns to the paper sheet stacking position after completion of the ejection, and the stacking tray comprises an arm extending radially from the rotary shaft for the stacking tray and a paper sheets placing plate bent by 90 degrees and extending from a tip part of the arm to compose the stacking part, and the stacked paper sheet-batch extraction area comprises a batch of paper sheets holding surface located at the upper rear of the rear-surface support part.

6. A paper sheet stacking method performed by the paper sheet processing device according to claim 5, wherein a paper sheet supply operation by the paper sheet supply and transport unit and a paper sheet emitting operation by the bladed wheel are stopped when stacking of a predetermined number of paper sheets on the stacking part being at the paper sheet stacking position is complete, and the paper sheet supply operation and the paper sheet emitting operation are resumed when the stacking part is rotationally moved to the non-stacking position to eject a batch of stacked paper sheets on the stacking part to the stacked paper sheet-batch extraction area, and then is rotated in a reverse direction to return to the paper sheet stacking position.

7. A stacking tray in a paper sheet processing device that includes a bladed wheel configured to include a plurality of blades projecting radially around a rotary shaft for the bladed wheel and a paper sheet holding space formed between the blades adjacent to each other to hold one received paper sheet, and sequentially emit one paper sheet each held in the paper sheet holding space to a predetermined stacking area at a time of rotation, and the stacking tray arranged in the stacking area to stack thereon in a standing state paper sheets emitted from each of the paper sheet holding spaces one by one and rotates in one direction around a rotary shaft for the stacking tray to eject a stacked batch of paper sheets, wherein the stacking tray comprises at least a first stacking part that stacks thereon emitted paper sheets when at a paper sheet stacking position under the rotary shaft for the stacking tray and comprises a first bottom plate being rotationally moved upward to a non-stacking position located above the rotary shaft for the stacking tray to eject a batch of paper sheets when a predetermined number of paper sheets are stacked thereon, and a second stacking part that is moved to the paper sheet stacking position to stack thereon emitted paper sheets when being rotated by a predetermined angle from the non-stacking position and comprises a second bottom plate being rotationally moved upward to the non-stacking position when a predetermined number of paper sheets are stacked thereon to eject the batch of paper sheets, and the stacking tray has a rotationally symmetric shape having a base plate integrated with the rotary shaft for the stacking tray at an intermediate part thereof to support a back surface of the batch of paper sheets, and the first bottom plate and the second bottom plate each projecting from opposite edges on an outer diameter side of the base plate with an angle of about 90 degrees and each comprising a paper sheet support surface supporting a lower end surface of the batch of paper sheets.

* * * * *